US012660914B2

(12) United States Patent
MacLachlan et al.

(10) Patent No.: US 12,660,914 B2
(45) Date of Patent: Jun. 23, 2026

(54) BED SYSTEM WITH OPTIONAL SIDE RAIL ACCESSORIES

(71) Applicant: Sleep Number Corporation, Minneapolis, MN (US)

(72) Inventors: Lori MacLachlan, Minneapolis, MN (US); Joseph Ermalovich, Santa Barbara, CA (US); Carli Hill, Oxnard, CA (US); Antony Kirk, Minnetonka, MN (US)

(73) Assignee: Sleep Number Corporation

( * ) Notice: Subject to any disclaimer, the term of this patent is extended or adjusted under 35 U.S.C. 154(b) by 448 days.

(21) Appl. No.: 18/091,713

(22) Filed: Dec. 30, 2022

(65) Prior Publication Data

US 2023/0210256 A1 Jul. 6, 2023

Related U.S. Application Data

(60) Provisional application No. 63/295,210, filed on Dec. 30, 2021.

(51) Int. Cl.

| | |
|---|---|
| ***A47B 23/00*** | (2006.01) |
| ***A47C 19/02*** | (2006.01) |
| ***A47C 21/08*** | (2006.01) |

(52) U.S. Cl.

CPC ..... *A47B 23/00* (2013.01); *A47C 19/022* (2013.01); *A47C 21/08* (2013.01)

(58) Field of Classification Search

None

See application file for complete search history.

(56) References Cited

U.S. PATENT DOCUMENTS

| | | | | |
|---|---|---|---|---|
| 4,305,168 | A | 12/1981 | Holter et al. | |
| 5,097,550 | A * | 3/1992 | Marra, Jr. | A61G 7/0524 5/663 |
| 6,817,661 | B2 * | 11/2004 | Zheng | A47C 7/54 297/27 |
| 8,444,558 | B2 | 5/2013 | Young et al. | |
| 8,672,853 | B2 | 3/2014 | Young | |
| 8,984,687 | B2 | 3/2015 | Stusynski et al. | |
| 9,273,709 | B2 * | 3/2016 | Mehringer | F16B 12/10 |
| 9,370,457 | B2 | 6/2016 | Nunn et al. | |
| 9,392,879 | B2 | 7/2016 | Nunn et al. | |
| 9,445,751 | B2 | 9/2016 | Young et al. | |

(Continued)

FOREIGN PATENT DOCUMENTS

| | | |
|---|---|---|
| CA | 2523168 | 2/2014 |
| JP | 4604258 | 1/2011 |

(Continued)

OTHER PUBLICATIONS

U.S. Appl. No. 16/719,177, Nunn et al., Dec. 18, 2019.

(Continued)

*Primary Examiner* — Adam C Ortiz

(74) *Attorney, Agent, or Firm* — Norton Rose Fulbright US LLP

(57) ABSTRACT

Described are bed systems with side rail accessories. A foundation can include a side rail accessory having at least one support pole and a first side rail having first and second mounting holes that can receive the support pole and support the side rail accessory. The side rail accessory can be a tabletop and/or handle with the support pole.

12 Claims, 28 Drawing Sheets

(56) References Cited

U.S. PATENT DOCUMENTS

| | | | |
|---|---|---|---|
| 9,504,416 | B2 | 11/2016 | Young et al. |
| 9,510,688 | B2 | 12/2016 | Nunn et al. |
| 9,635,953 | B2 | 5/2017 | Nunn et al. |
| 9,770,114 | B2 | 9/2017 | Brosnan et al. |
| 9,815,439 | B2 | 11/2017 | Lemire et al. |
| 9,844,275 | B2 | 12/2017 | Nunn et al. |
| 9,931,085 | B2 | 4/2018 | Young et al. |
| 10,058,467 | B2 | 8/2018 | Stusynski et al. |
| 10,092,242 | B2 | 10/2018 | Nunn et al. |
| 10,149,549 | B2 | 12/2018 | Erko et al. |
| 10,182,661 | B2 | 1/2019 | Nunn et al. |
| 10,201,234 | B2 | 2/2019 | Nunn et al. |
| 10,251,490 | B2 | 4/2019 | Nunn et al. |
| 10,342,358 | B1 | 7/2019 | Palashewski et al. |
| 10,441,086 | B2 | 10/2019 | Nunn et al. |
| 10,441,087 | B2 | 10/2019 | Karschnik et al. |
| 10,448,749 | B2 | 10/2019 | Palashewski et al. |
| 10,492,969 | B2 | 12/2019 | Stusynski et al. |
| 10,632,032 | B1 | 4/2020 | Stusynski et al. |
| 10,646,050 | B2 | 5/2020 | Nunn et al. |
| 10,674,832 | B2 | 6/2020 | Brosnan et al. |
| 10,716,512 | B2 | 7/2020 | Erko et al. |
| 10,729,255 | B2 | 8/2020 | Erko et al. |
| 10,736,432 | B2 | 8/2020 | Brosnan et al. |
| 10,750,875 | B2 | 8/2020 | Palashewski et al. |
| 10,827,846 | B2 | 11/2020 | Karschnik et al. |
| 10,881,219 | B2 | 1/2021 | Nunn et al. |
| 10,957,335 | B2 | 3/2021 | Demirli et al. |
| 10,959,535 | B2 | 3/2021 | Karschnik et al. |
| D916,745 | S | 4/2021 | Stusynski et al. |
| 10,980,351 | B2 | 4/2021 | Nunn et al. |
| 11,096,849 | B2 | 8/2021 | Stusynski et al. |
| 11,122,909 | B2 | 9/2021 | Palashewski et al. |
| 11,160,683 | B2 | 11/2021 | Nunn et al. |
| 11,206,929 | B2 | 12/2021 | Palashewski et al. |
| D954,725 | S | 6/2022 | Stusynski et al. |
| D968,436 | S | 11/2022 | Stusynski et al. |
| D975,121 | S | 1/2023 | Stusynski et al. |
| 2008/0077020 | A1 | 3/2008 | Young et al. |
| 2010/0170043 | A1 | 7/2010 | Young et al. |
| 2011/0144455 | A1 | 6/2011 | Young et al. |
| 2014/0277822 | A1 | 9/2014 | Nunn et al. |
| 2016/0015184 | A1 | 1/2016 | Nunn et al. |
| 2016/0367039 | A1 | 12/2016 | Young et al. |
| 2017/0065220 | A1 | 3/2017 | Young et al. |
| 2017/0128001 | A1 | 5/2017 | Torre et al. |
| 2017/0143269 | A1 | 5/2017 | Young et al. |
| 2019/0053761 | A1 | 2/2019 | Torre et al. |
| 2019/0069840 | A1 | 3/2019 | Young et al. |
| 2019/0200777 | A1 | 7/2019 | Demirli et al. |
| 2019/0201265 | A1 | 7/2019 | Sayadi et al. |
| 2019/0201266 | A1 | 7/2019 | Sayadi et al. |
| 2019/0201267 | A1 | 7/2019 | Demirli et al. |
| 2019/0201268 | A1 | 7/2019 | Sayadi et al. |
| 2019/0201270 | A1 | 7/2019 | Sayadi et al. |
| 2019/0201271 | A1 | 7/2019 | Grey et al. |
| 2019/0328146 | A1 | 10/2019 | Palashewski et al. |
| 2019/0328147 | A1 | 10/2019 | Palashewski et al. |
| 2020/0121529 | A1 | 4/2020 | Tessmer et al. |
| 2020/0315367 | A1 | 10/2020 | Demirli et al. |
| 2020/0336010 | A1 | 10/2020 | Holmvik et al. |
| 2020/0337470 | A1 | 10/2020 | Sayadi et al. |
| 2020/0359807 | A1 | 11/2020 | Brosnan et al. |
| 2020/0367663 | A1 | 11/2020 | Nunn et al. |
| 2020/0405070 | A1 | 12/2020 | Palashewski et al. |
| 2020/0405240 | A1 | 12/2020 | Palashewski et al. |
| 2021/0000261 | A1 | 1/2021 | Erko et al. |
| 2021/0034989 | A1 | 2/2021 | Palashewski et al. |
| 2021/0045541 | A1 | 2/2021 | Nunn et al. |
| 2021/0068552 | A1 | 3/2021 | Palashewski et al. |
| 2021/0069041 | A1 | 3/2021 | Roussy et al. |
| 2021/0112992 | A1 | 4/2021 | Nunn et al. |
| 2021/0267380 | A1 | 9/2021 | Stusynski |
| 2021/0282570 | A1 | 9/2021 | Karschnik et al. |
| 2021/0289947 | A1 | 9/2021 | Karschnik et al. |
| 2021/0314405 | A1 | 10/2021 | Demirli et al. |
| 2021/0337975 | A1* | 11/2021 | Drever ..... A47C 20/043 |
| 2021/0346218 | A1 | 11/2021 | Stusynski et al. |
| 2022/0000273 | A1 | 1/2022 | Palashewski et al. |
| 2022/0000654 | A1 | 1/2022 | Nunn et al. |
| 2022/0225786 | A1 | 7/2022 | Palashewski et al. |
| 2022/0265059 | A1 | 8/2022 | Palashewski et al. |
| 2022/0305231 | A1 | 9/2022 | Stusynski et al. |
| 2022/0346565 | A1 | 11/2022 | Karschnik et al. |
| 2022/0354431 | A1 | 11/2022 | Molina et al. |
| 2022/0386947 | A1 | 12/2022 | Molina et al. |
| 2022/0395233 | A1 | 12/2022 | Siyahjani et al. |
| 2023/0018558 | A1 | 1/2023 | Demirli et al. |
| 2023/0035257 | A1 | 2/2023 | Karschnik et al. |
| 2023/0037482 | A1 | 2/2023 | Demirli et al. |
| 2023/0054736 | A1 | 2/2023 | Holmvik et al. |
| 2023/0063373 | A1 | 3/2023 | Young et al. |

FOREIGN PATENT DOCUMENTS

| | | | |
|---|---|---|---|
| JP | 3219880 | 1/2019 | |
| JP | 3219880 U * | 1/2019 | |
| WO | WO-2018003367 A1 * | 1/2018 | ..... A47C 21/08 |

OTHER PUBLICATIONS

U.S. Appl. No. 17/523,349, Dixon et al., Nov. 10, 2021.
U.S. Appl. No. 17/745,508, Nunn et al., May 16, 2022.
U.S. Appl. No. 17/984,752, Karschnik et al., Nov. 10, 2022.
U.S. Appl. No. 17/986,351, Nunn et al., Nov. 14, 2022.
U.S. Appl. No. 18/075,913, Johnston et al., Dec. 6, 2022.
U.S. Appl. No. 18/084,944, Molina, Dec. 20, 2022.
U.S. Appl. No. 18/086,003, Kirk et al., Dec. 21, 2022.
U.S. Appl. No. 18/086,104, Hill et al., Dec. 21, 2022.
U.S. Appl. No. 18/087,078, Hill et al., Dec. 22, 2022.
U.S. Appl. No. 18/087,973, Hill et al., Dec. 23, 2022.
U.S. Appl. No. 18/105,468, Sayadi et al., Feb. 3, 2023.
U.S. Appl. No. 29/814,835, filed Nov. 9, 2021, Dixon et al.
U.S. Appl. No. 29/837,293, filed May 4, 2022, Stusynski et al.
U.S. Appl. No. 29/881,955, filed Jan. 9, 2023, Stusynski et al.
International Search Report and Written Opinion in International Appln. No. PCT/US2022/054343, mailed on Apr. 19, 2023, 14 pages.
International Preliminary Report on Patentability in International Appln. No. PCT/US2022/054343, mailed on Jun. 20, 2024, 9 pages.

* cited by examiner

BED SYSTEM WITH OPTIONAL SIDE RAIL ACCESSORIES

INCORPORATION BY REFERENCE

This application claims priority to U.S. Provisional Application Ser. No. 63/295,210, filed on Dec. 30, 2021, the disclosure of which is incorporated by reference in its entirety.

TECHNICAL FIELD

This document describes devices, systems, and methods generally related to a bed system for side rail accessories.

BACKGROUND

In general, a bed is a piece of furniture used as a location to sleep or relax. Many modern beds include a soft mattress on a bed frame. The mattress may include springs, foam material, and/or an air chamber to support the weight of one or more occupants.

SUMMARY

The document generally relates to a bed system that can receive optional side rail accessories as well as optional side rail accessories for use in the bed system. More specifically, the bed system can include a foundation having first and second side rails opposite each other. Each of the side rails can include mounting holes and a support structure inside the side rail that can receive support poles of a side rail accessory. The side rail accessory can be a tabletop and one or more support poles. The side rail accessory can also be a handle and one or more support poles. The side rail accessory can provide additional functionality to users of the bed system. For example, if the side rail accessory includes the tabletop, a user of the bed system can set various items/objects on the tabletop. As another example, the tabletop and/or handle can be used as a mobility aid for any user of the bed system. The side rail accessory can help a user maneuver in and around the bed system. The configuration of the side rail accessory mounted to the bed system can allow for supporting up to approximately 300 pounds (lb).

A mounting configuration of the support poles in the mounting holes can make it possible for the user to reverse the side rail accessory. In other words, the user can set the support poles in either direction inside the mounting holes so that the tabletop side rail accessory, for example, can extend outwards, away from a mattress of the bed system, or inwards, over a portion of the mattress. By reversing a direction of the table from outward to inward-facing, the user can work on a laptop placed on the tabletop while in bed, eat a meal while in bed, and/or perform other activities that may require the tabletop to be positioned partially over the mattress of the bed system.

One or more embodiments described herein can include a foundation including a first side rail having first and second mounting holes that can receive support poles of a side rail accessory and support the side rail accessory.

In some implementations, the embodiments described herein can optionally include one or more of the following features. For example, the foundation can also include a second side rail positioned opposite of the first side rail and a headboard extending across a head of the foundation. The headboard, the first side rail, and the second side rail can be operably connected.

The foundation can also include the side rail accessory having the support poles. The side rail accessory can include a tabletop and the support poles. The tabletop can include an opening that can receive one or more cables for charging a user device. The first and second mounting holes can be a same size and the support poles can be a same size, such that the side rail accessory can be reversed with either of the support poles in either of the first and second mounting holes.

As another example, the side rail accessory can include a handle and at least one of the support poles.

The support poles of the side rail accessory can have a fixed height within a range of 750-1000 mm. The support poles can be symmetrical and sized to be received in either of the first and second mounting holes of the first side rail.

The foundation can also include a plate that can extend a length over of a top portion of the first side rail, the plate being configured to cover the first and second mounting holes. The plate can include first and second prongs that can be positioned on an underside of the plate and can be configured to align with the first and second mounting holes. The first and second prongs can plug the first and second mounting holes when the first and second prongs are received by the first and second mounting holes. The first and second prongs can be equally sized to fit into either of the first and second mounting holes. The plate can include a first portion that can extend a width of the top portion of the first side rail and a second portion that can extend a length down an external facing side of the first side rail. The first and second portions of the plate can join at an external facing edge of the first side rail. The plate can be at least one of leather, a plastic core wrapped in leather, a metal material upholstered in fabric, and a metal material.

In some implementations, the foundation can also include a rail cover that can extend a length over of a top portion of the first side rail, the rail cover having first and second receiving holes that can be configured to align with the first and second mounting holes of the first side rail. The first and second receiving holes can be a same size as the first and second mounting holes. The first and second receiving holes can be configured to receive the support poles of the side rail accessory. Moreover, the rail cover can include a first portion that extends a width of the top portion of the first side rail and a second portion that can extend a length down an external facing side of the first side rail. The first and second portions of the plate can join at an external facing edge of the first side rail. The rail cover can be leather.

Moreover, the first and second mounting holes can be equally spaced apart from each other along a top portion of the first side rail. The first mounting hole can be positioned closer to a head of the foundation than a foot of the foundation. The second mounting hole can be positioned closer to a foot of the foundation than a head of the foundation.

In some implementations, cavities can be formed in the first side rail that can be configured to receive portions of the support poles. The respective bottoms of the cavities can be positioned within a range of 50-115 mm above the ground on which the foundation rests. The foundation an also include a connector that can be configured to retain a first support pole of the support poles in the first mounting hole. Sometimes, the first support pole can define an indentation at a distal end of the first support pole and the connector can be configured to mate with the indentation.

In some implementations, the first and second mounting holes can be symmetrical. The support poles can be titanium. The support poles can be bent steel having hollow interiors.

The handle can be shaped in an arc. The handle can be shaped as a partial hexagon. The handle can have a width within a range of 20-80 mm. The tabletop can include a steel plate on a bottom surface of the tabletop for structural rigidity. The tabletop can have a width within a range of 15-35 mm. Each of the support poles for the handle can have a length within a range of 750-1000 mm.

Additionally, the foundation can include first and second fabric panels sized and configured to cover the first and second mounting holes when the support poles are not positioned therein. The first and second fabric panels can be integrated into an edge of the first side rail and can be configured to fold over the first and second mounting holes. The first and second fabric panels can include hook-and-loop fasteners. The side rail accessory can also be configured to support 300 lb. In some implementations, the second side rail can include third and fourth mounting holes that can receive support poles of a second side rail accessory and support the second side rail accessory. The support poles each can have a proximal end rigidly mounted to a bottom of the tabletop. The first and second mounting holes can be parallel and extend vertically down into the first side rail.

The first side rail can have a first side rail top surface, a first side rail bottom surface, a first side rail inner surface, and a first side rail outer surface. The first and second mounting holes can extend into the first side rail top surface. The first and second mounting holes can extend from first and second mounting hole inlets positioned in the first side rail top surface and terminate at first and second mounting hole ends positioned above the first side rail bottom surface.

In some implementations, the first and second mounting holes can be a same size, the support poles can be a same size, and either of the support poles can be configured to fit into either of the first and second mounting holes. The handle can be shaped as a partial hexagon.

One or more embodiments described herein include a foundation including a side rail accessory having at least one support pole, a first side rail having first and second mounting holes that can be configured to receive the at least one support pole of the side rail accessory and support the side rail accessory, a second side rail positioned opposite of the first side rail, and a headboard extending across a head of the foundation. The headboard, the first side rail, and the second side rail can be operably connected.

In some implementations, the foundation can optionally include one or more of the following features. For example, the side rail accessory can include a tabletop, and the at least one support pole can include first and second support poles. The side rail accessory can include a handle, and the at least one support pole can include first and second support poles. The handle can include first and second ends that bend down towards a top surface of the first side rail, the first and second ends of the handle can form a half-hexagon shape. The side rail accessory can include first and second support poles, the first support pole being configured to mount in the first mounting hole and the second support pole being configured to mount in the second mounting hole. The side rail accessory can include a top horizontal support rail and a bottom horizontal support rail. Each of the top and bottom horizontal support rails can extend laterally between the first and second support poles, the top horizontal support rail extending laterally between the first and second support poles closer to a bottom surface of the handle and the bottom horizontal support rail extending laterally between the first and second support poles closer to the top surface of the first side rail. The top and bottom horizontal support rails and the first and second support rails can define a gap. The side rail accessory further can include a wrap material that extends over a portion of the gap, the wrap material being configured to attach to the top and bottom horizontal support rails. The wrap material can include a pocket positioned on a side of the wrap material that is adjacent to a side of a mattress that is positioned on top of the foundation.

One or more embodiments described herein can include a foundation having a side rail accessory having at least one support pole and a first side rail having first and second mounting holes that can be configured to receive the at least one support pole of the side rail accessory and support the side rail accessory.

In some implementations, the foundation can optionally include one or more of the following features. For example, the foundation further can include a second side rail positioned opposite of the first side rail and a headboard extending across a head of the foundation. The headboard, the first side rail, and the second side rail can be operably connected. The side rail accessory can include a tabletop and the at least one support pole. The first and second mounting holes can be a same size. The side rail accessory can be configured to be reversed when the at least one support pole is placed in either of the first and second mounting holes. The side rail accessory can include a handle and the at least one support pole. The first and second mounting holes can be equally spaced apart from each other along a top portion of the first side rail. The first mounting hole can be positioned closer to a head of the foundation than a foot of the foundation. Moreover, the second mounting hole can be positioned closer to a foot of the foundation than a head of the foundation.

The devices, system, and techniques described herein may provide one or more of the following advantages. For example, the side rail accessory can be used as a discrete mobility aid for any type of user. The handle as well as the tabletop can serve as mobility aids to assist the user in moving in and around the bed system. An ergonomic design of the support poles can provide a preferred height for helping any type of user maneuver in and around the bed system. Moreover, the tabletop can be a discrete mobility aid and provides various functionality to the users of the bed system, thereby improving aesthetic appeal of this side rail accessory and the overall bed system.

Similarly, various components of the bed system described herein improve aesthetic appeal of the bed system. For example, the user can choose between different styles of tabletops and handles for the side rail accessory. When the user does not attach the side rail accessory to the bed system, a plate can cover the mounting holes to improve aesthetic appeal of the bed system. The plate can be made of a material, such as leather, that can match a style of upholstery material of the side rails. As a result, the plate may blend in with the side rails, thereby improving aesthetic appeal of the bed system. As another example, a rail cover can be used in combination with the side rail accessory. The rail cover can cover a portion of the side rail around the mounting holes while the support poles are in the mounting holes. Like the plate, the rail cover can be made of a material that can match the style of upholstery material of the side rails so that the side rail accessory, the rail cover, and the side rails can blend together and improve aesthetic appeal of the bed system.

Moreover, the bed system can have a strong and durable design, engineered using high quality textiles, fine hardwoods, durable leather, and other materials that make the bed system sturdy and aesthetically pleasing. The bed system can also have accented tailoring and layering of materials to provide an aesthetically pleasing appearance. For example, the tabletops can be made with fine hardwoods that are aesthetically pleasing. Durable leather can be used for the plate and/or the rail cover, which can provide additional support for the support rail accessory as well as improve aesthetic appearance of the bed system. Materials and width of the support poles can provide sturdy support of various weights (e.g., up to 300 lb). The support poles can be made of steel, titanium, or other lightweight, strong materials.

As another example, the tabletop support rail accessory can be reversed, which can increase its functionality for users of the bed system. For example, the tabletop support rail accessory can be used (i) to support items near the bed system, (ii) to support items over the bed system, and (iii) as a discrete mobility aid. The tabletop support rail accessory can be reversibly mounted to the bed system since both the support poles and the mounting holes in the side rails can be equally sized and/or shaped (e.g., symmetrical). Therefore, the user of the bed system can easily mount the tabletop support rail accessory on either of the side rails in an outward or inward-facing direction to accommodate any of the user's needs.

As yet another example, the users of the bed system can customize their bed system with different types of side rail accessories, or no side rail accessories if they desire. Users have an option whether to attach side rail accessories to the bed system. The bed system can be manufactured with the mounting holes and purchased by a user without any side rail accessories. The user can optionally choose to purchase one or more side rail accessories with the bed system. Once the user has the bed system, the user can choose to mount a side rail accessory to only one side rail or to mount side rail accessories to the bed system whenever the user desires. The mounting configuration for the side rail accessories can be simple and intuitive, thereby making it quick and easy for any type of user to attach side rail accessories, remove side rail accessories, and/or swap out different side rail accessories to meet their various needs. Moreover, if the user chooses not to attach side rail accessories to the bed system, plates can be easily placed on top of the side rails to plug and cover the mounting holes, thereby improving aesthetic appeal of the bed system.

Furthermore, while designed to support sleep needs for users of any age, some of the embodiments of the disclosed features and techniques of the bed system can be especially useful to satisfy needs of a discrete aging population. Thus, the disclosed techniques can provide unique and dynamic abilities to adapt to any user of the bed system, no matter their needs.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

This document generally relates to a bed system that can support different types of side rail accessories. For example, the bed system can include a foundation having side rails that are opposite each other. Each of the side rails can include equally spaced and structured mounting holes configured to receive support poles of various side rail accessories. The side rail accessories can include tabletops and handles. These side rail accessories can be used as mobility aids for any type of user of the bed system. The tabletops can also be used for maintaining items/objects near/around the bed system. Moreover, because the mounting holes can be equally/symmetrically shaped and sized, support poles can be mounted therein in any direction. As a result, side rail accessories, such as the tabletops, can be reversibly attached to the bed system. The tabletops can therefore face outwards towards sides of the bed system or inwards over a portion of a mattress of the bed system, thereby increasing functionality of the tabletops for users of the bed system.

Figure 1:
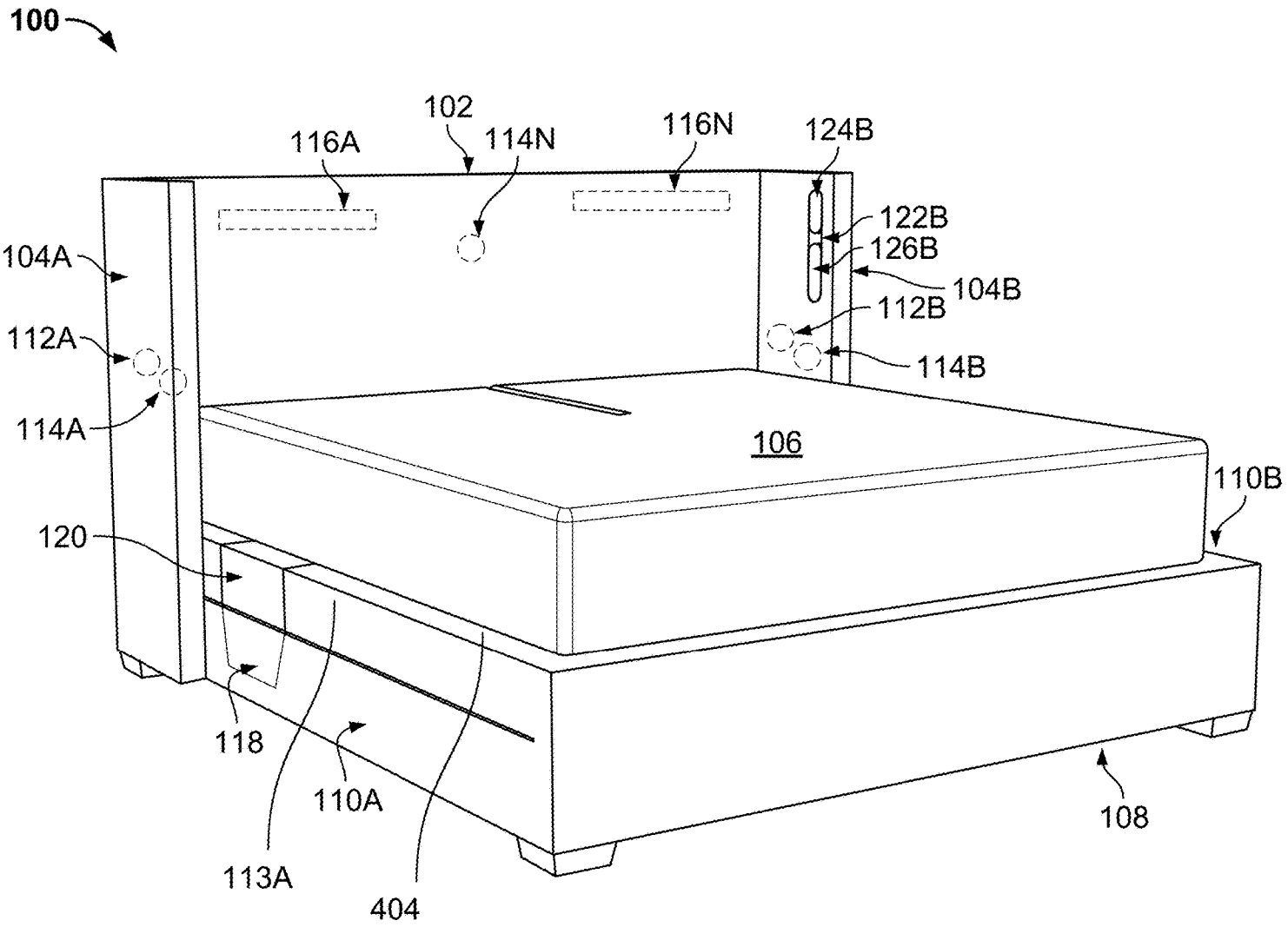
FIG. 1 depicts an example bed system.

Referring to the figures, FIG. 1 depicts an example bed system 100. The bed system 100 can include features that provide an improved sleep experience for a user of the bed system, including users having different age, conditions, demographics, and/or preferences.

The bed system 100 can include a headboard 102, foundation 108, and mattress 106. The mattress 106 can be sized for one user, such as a twin mattress. The mattress 106 can also be sized for two users, such as a full, queen, king, and/or California king mattress. As illustrated in FIG. 1, the mattress 106 can be a king mattress having a split top portion and a joined bottom portion. The mattress 106 can be an air mattress or other suitable mattress. The mattress 106 can also be articulable or stationary.

The headboard 102 can include a main headboard portion 201 and wings 104A and 104B. The wings 104A and 104B can extend a length along lateral edges of the mattress 106. In some implementations, the length can be 5 to 20 inches. In some implementations, the length can be 13 inches. For example, the wings 104A and 104B can extend to a length along the lateral edges of the mattress 106 that includes a head portion of the mattress 106 where the user may place their head on a pillow. As a result, the wings 104A and 104B can act as a barrier to some noises that may exist in a surrounding sleep environment.

The headboard 102 can include features for improving sleep experiences of the user of the bed system 100. For example, the headboard 102 can include speakers 112A and 112B, microphones 114A-N, lights 116A-N, docks 122A and 122B, reading lights 124A and 124B, and remotes 126A and 126B. The speakers 112A and 112B can be integrated into the wings 104A and 104B, respectively. The speakers 112A and 112B can be configured to play white and/or pink noise to reduce and/or cancel noise in the surrounding sleep environment. The user can connect one or more user devices (e.g. mobile phone, tablet, PC, or other computer) or another audio input to the speakers 112A and 112B (e.g., Bluetooth connection) to control audio that is played through the speakers 112A and 112B.

The microphones 114A and 114B can be integrated into the wings 104A and 104B, respectively. Additional microphones can also be integrated into other portions of the bed system 100. For example, the microphone 114N can be integrated into a midpoint of the headboard 102. Additional microphones can be integrated into the headboard 102 for each respective user/side of the mattress 106. The microphones 114A-N can be configured to detect noise in the surrounding sleep environment (such as snore or breathing sounds of one or both users, external noises, etc.). Based on the detected noise, the bed system 100 (e.g., a bed controller, such as controller 500 in FIG. 5) can generate an inverse sound wave to play through the speakers 112A and 112B to reduce and/or cancel the detected noise. As a result, the user of the bed system 100 can experience improved sleep quality undisturbed by noises in the surrounding sleep environment (e.g., snore or breathing sounds of one or both users, external noises, etc.).

The lights 116A-N can be integrated into a back portion of the headboard 102. The lights 116A-N, for example, can be recessed into the back portion of the headboard 102 and configured to provide ambient lighting that supports the user's circadian rhythm with wake and sleep routines.

The docks 122A and 122B can be integrated into the wings 104A and 104B, respectively. The docks 122A and 112B can house components such as the reading lights 124A and 124B, respectively, and the remotes 126A and 126B, respectively. These components can be kept in easy to access locations. In some embodiments, the user of the bed system 100 can access either of the reading lights 124A and 124B and/or the remotes 126A and 126B regardless of whether the user is laying down, sitting up, or otherwise inclined on the mattress 106. The reading lights 124A and 124B can extend out from the respective docks 122A and 122B and be tilted in a desired direction of the user. The user can also adjust the reading lights 124A and 124B color and intensity based on their particular needs and preferences. The remotes 126A and 126B can be used by the user to adjust their respective side of the bed system 100. For example, the remotes 126A and 126B can be used to adjust audio (e.g., volume level, turning audio on or off, setting a timer to automatically turn off the audio, etc.) that is played through the speakers 112A and 112B.

The foundation 108 includes side rails 110A and 110B. The side rails 110A and 110B each have an inner surface, an outer surface, and a top surface. As shown in FIGS. 8A, 9A-9C, 10, and 11, the side rail 110A has an inner surface 111A. As shown in FIG. 5, the side rail 110B has an inner surface 111B. As shown in FIGS. 1, 2A-2D, 2F, 2G, 3B, 4, and 5, the side rail 110A has an outer surface 113A. As shown in FIG. 2F, the side rail 110B has an outer surface 113B. The top surface 404 of respective side rail 110A or 110B extends between the associated inner surface 111A/111B and the outer surfaces 113A/113B. Pockets 118A and 118B (pocket 118B is not depicted in FIG. 1) can be integrated into the side rails 110A and 110B, respectively. The pockets 118A and 118B can be storage pockets for holding objects including but not limited to mobile devices (e.g., laptops, tablets, mobile phones, smart phones, etc.), books, magazines, and other items. The pockets 118A and 118B can include integrated inductive charging capabilities to charge one or more of the mobile devices placed therein. The pockets 118A and 118B can also include charging ports to provide wired charging of the mobile devices. The charging ports can include USB and USC ports. The pockets 118A and 118B can be integrated into portions of the side rails 110A and 110B that are easy to reach by the user of the bed system 100, regardless of whether the user is laying down, sitting up, or inclined to another position on the mattress 106.

Moreover, plates 120A and 120B (plate 120B is not depicted in FIG. 1) can be removably attached to a portion of the side rails 110A and 110B, respectively, that is aligned with and above the pockets 118A and 118B, respectively. The plates 120A and 120B can cover holes that are integrated into the side rails 110A and 110B and configured to receive and support side rail accessories (e.g., refer to FIGS. 2-7). The side rail accessories (e.g., refer to FIGS. 2-7) can include tabletops and handrails, which can improve functionality of the bed system 100 and assist the user of the bed system 100 to get in and out of bed. The plates 120A and 120B can provide an aesthetically pleasing appearance of the foundation 108 when side rail accessories are not attached to the side rails 110A and 110B. When the side rail accessories are attached to either of the side rails 110A and 110B, the corresponding plate 120A or 120B can be removed so that the holes are exposed to receive supports of the side rail accessories, as described below.

Figure 2A:
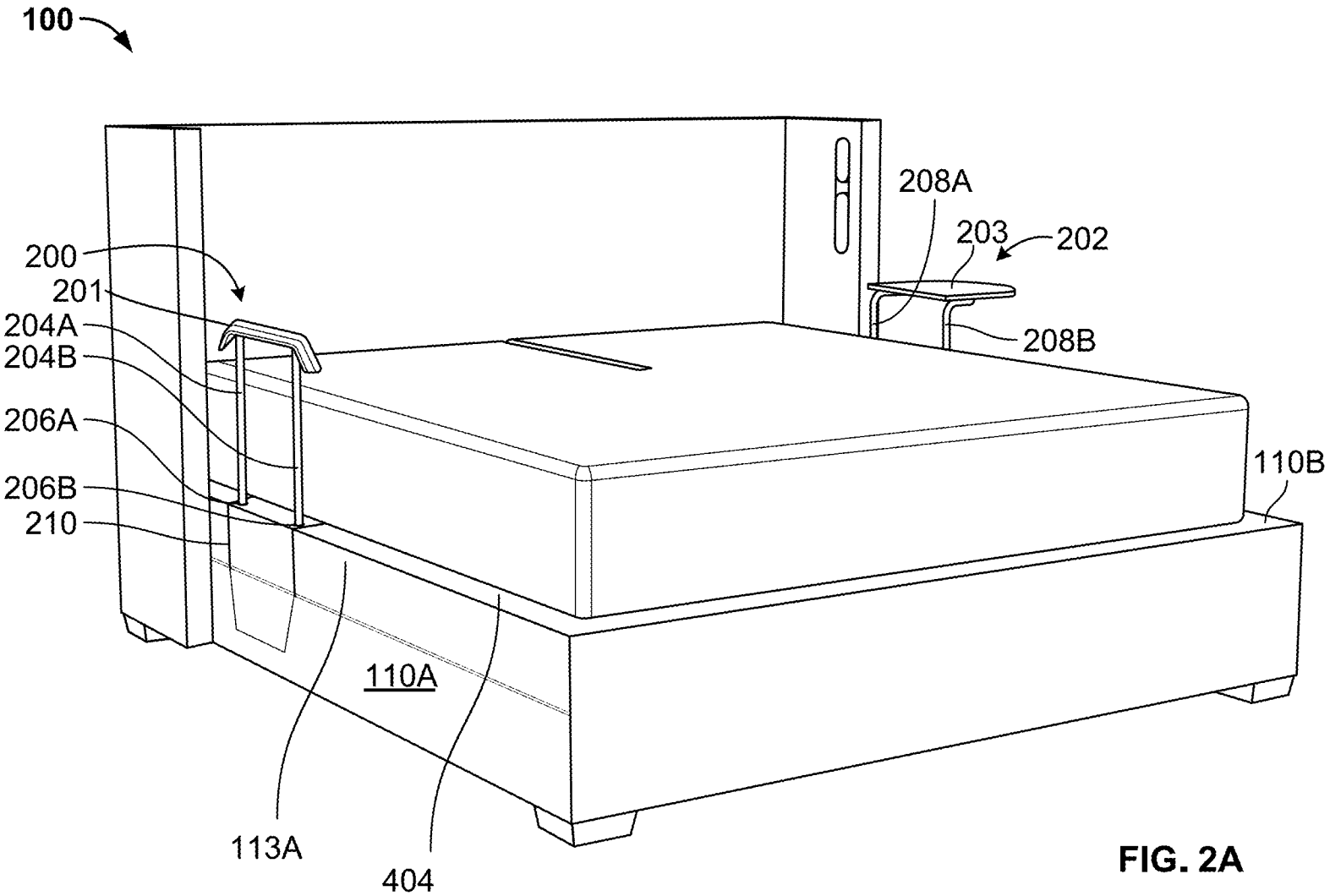
FIG. 2A depicts the bed system with handle and tabletop side rail accessories.

FIG. 2A depicts the bed system 100 with a handle accessory 200 and a tabletop accessory 202. The handle accessory 200 can include a handle 201 and support poles 204A and 204B. The side rail 110A can include mounting holes 206A and 206B. The support poles 204A and 204B can be received into either of the mounting holes 206A and 206B in embodiments in which the mounting holes 206A and 206B are a same size and in which the support poles 204A and 204B are also a same size. For example, the support poles 204A and 204B can be symmetrical and sized to be received in either of the mounting holes 206A and 206B of the side rail 110A. As a result, the handle accessory 200 can be reversed with either of the support poles 204A and 204B being positioned in either of the mounting holes 206A and 206B. A rail cover 210 can also be removably attached to the side rail 110A. As described in reference to FIG. 4, the rail cover 210 can include receiving holes that align with the mounting holes 206A and 206B such that the support poles 204A and 204B can be received through both the receiving holes of the rail cover 210 and the mounting holes 206A and 206B of the side rail 110A.

As described throughout this disclosure, the side rail 110B can be positioned opposite the side rail 110A and can also include mounting holes (e.g., refer to FIG. 6) for attaching a side rail accessory to the side rail 110B. In the example of FIG. 2A, the tabletop accessory 202 is mounted to the side rail 110B. The tabletop accessory 202 includes a tabletop 203 and support poles 208A and 208B. As described in reference to the support poles 204A and 204B, the support poles 208A and 208B may also be a same size. In other words, the support poles 208A and 208B can be symmetrical and sized to be received in either of mounting holes (not depicted) of the side rail 110B. As a result, the tabletop accessory 202 can be reversed with either of the support poles 208A and 208B being positioned in either of the mounting holes of the side rail 110B (e.g., refer to FIG. 2F). A rail cover (not depicted but similar to the rail cover 210) can also be removably attached to the side rail 110B as described in reference to the rail cover 210.

The support poles 204A and 204B can be mounted in the side rail 110B and the support poles 208A and 208B can also be mounted in the side rail 110A. The support poles 204A, 204B, 208A, and 208B can be symmetrical and/or equally sized so that they can be received in either of the side rails 110A or 110B. The support poles 204A, 204B, 208A, and 208B can be made of a durable and sturdy material to be able to support various weights, such as up to approximately 300 lb. For example, the support poles 204A, 204B, 208A, and 208B can be made of bent steel having hollow interiors. In some implementations, the support poles 204A, 204B, 208A, and 208B can be made of titanium or other similar materials. In alternative embodiments, the support poles 204A, 204B, 208A, and 208B need not be symmetrical.

Figure 2B:
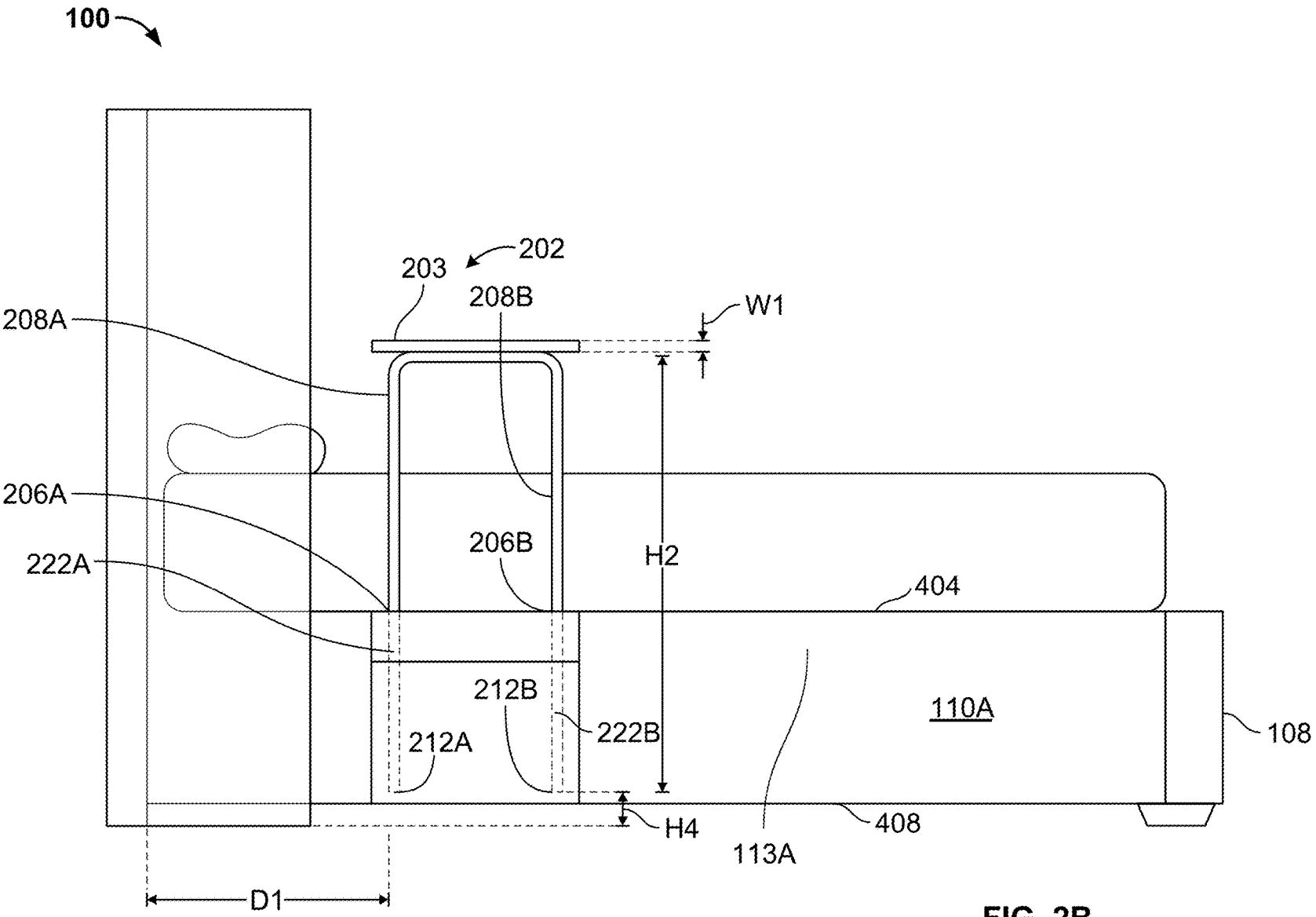
FIG. 2B is a side view of the bed system with a tabletop side rail accessory.

FIG. 2B is a side view of the bed system 100 with the tabletop accessory 202. In this example, the support poles 208A and 208B of the tabletop accessory 202 are mounted in the mounting holes 206A and 206B of the side rail 110A.

The tabletop 203 can include a steel plate or other similar material on a bottom surface of the tabletop 203 for structural rigidity. The support poles 208A and 208B can include proximal ends rigidly mounted to the bottom surface of the tabletop 202. The support poles 208A and 208B can have a fixed height H2. Support poles for one or more tabletop side rail accessories can have the same H2. In some implementations, support poles for one or more tabletop side rail accessories can have different heights. H2 can be within a range of 750-1000 mm. In some implementations, as shown in FIG. 2B, H2 can be 817.5 mm. The tabletop 203 can have a width W1. W1 can be within a range of 15-35 mm. In some implementations, as shown in FIG. 2B, W1 can be 20 mm. Moreover, a length and width of the tabletop 203 be within a range of 150-400 mm.

The mounting holes 206A and 206B can be symmetrically shaped and equally spaced apart from each other along a top surface 404 (e.g., rail top surface, top portion) of the side rail 110A. The mounting holes 206A and 206B can be parallel and extend vertically down into the top surface 404 of the side rail 110A. The mounting hole 206A can be positioned closer to a head of the foundation 108 than a foot of the foundation 108. For example, the mounting hole 206A can be a distance D1 from the head of the foundation 108. D1 can be within a range of 400-600 mm. In some implementations, for example, D1 can be 517 mm. D1 can be beneficial for a user to reach the support rail accessory that is mounted in the mounting holes 206A and 206B, regardless of whether the user is laying down flat, sitting up, or otherwise inclined in another position in the bed system 100. The mounting hole 206B can be positioned closer to the foot of the foundation 108 than the head of the foundation 108.

Cavities 222A and 222B are formed in the side rail 110A. When the support poles 208A and 208B are received through the respective mounting holes 206A and 206B, the support poles 208A and 208B can be received in the respective cavities 222A and 222B. Respective bottoms 212A and 212B (e.g., bases, mounting hole ends) of the cavities 222A and 222B can be positioned a height H4 above the ground on which the bed system 100 rests. Thus, the cavities 222A and 222B can extend from the respective mounting hole inlets 206A and 206B positioned in the top surface 404 of the side rail 110A and terminate at the bottoms 212A and 212B positioned above a bottom surface 408 of the side rail 110A. H4 can be within a range of 50-115 mm. In some implementations, for example, H4 can be 65 mm.

Figure 2C:
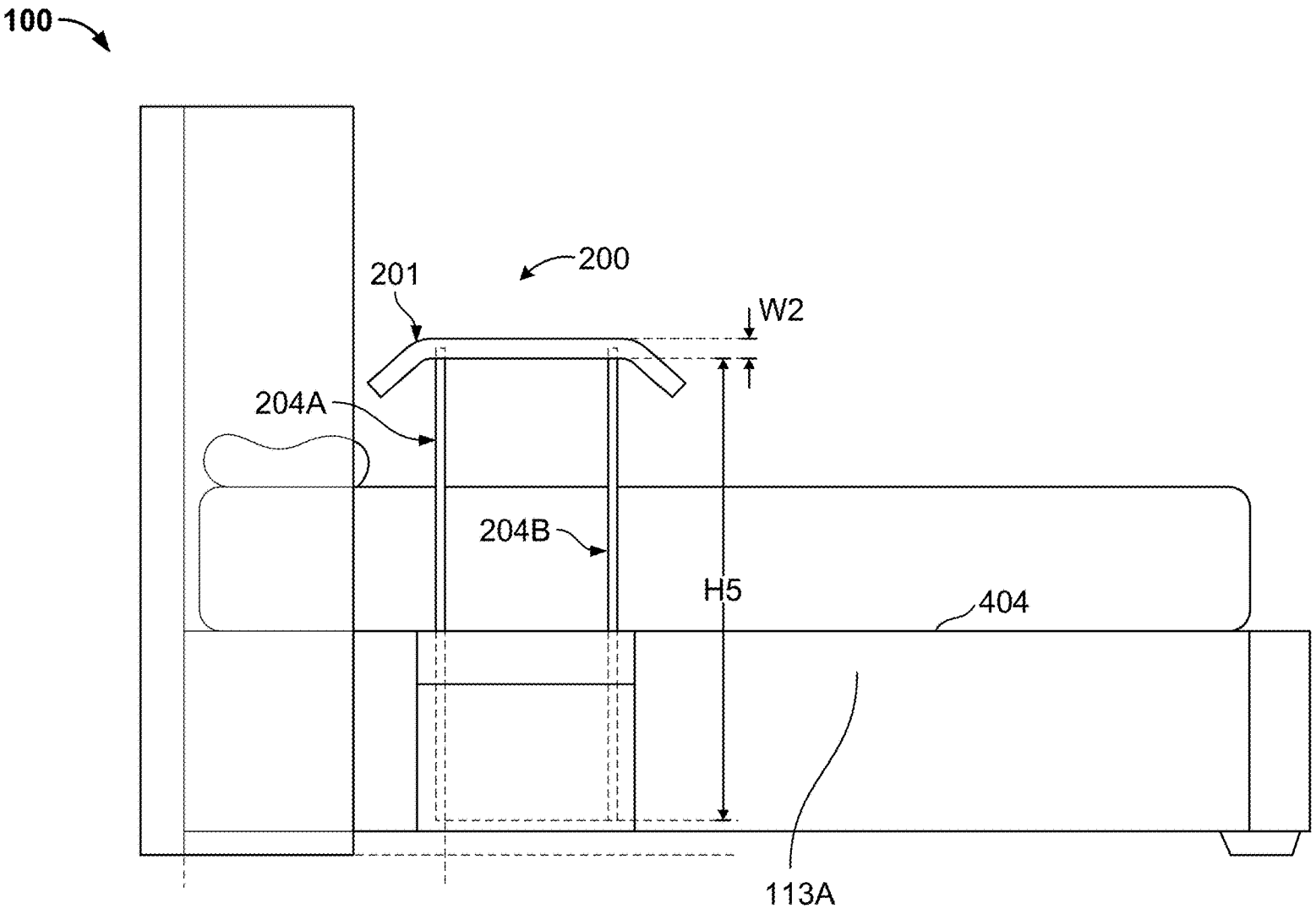
FIG. 2C is a side view of the bed system with a handle side rail accessory.

FIG. 2C is a side view of the bed system 100 with the handle accessory 200. In the example of FIG. 2C, the handle 201 of the handle accessory 200 is a half hexagon, or partial hexagon, arm design. The handle 201 can have various other designs, as described further below. The handle 201 can have a width W2. W2 can be within a range of 20-80 mm. In some implementations, for example, W2 can be 27.5 mm. W2 of the handle 201 can be a sufficient width to provide support and security for a user using the handle 200 as a mobility aid to maneuver in and around the bed system 100.

The support poles 204A and 204B can have a fixed height H5. H5 can be within a range of 600-1100 mm. In some implementations, for example, H5 can be 914.4 mm. H5 can be ergonomic and beneficial for assisting users of the bed system 100 to get in and out of bed, regardless of whether a user is laying down flat, sitting up, or in any other position in the bed system 100.

Figure 2D:
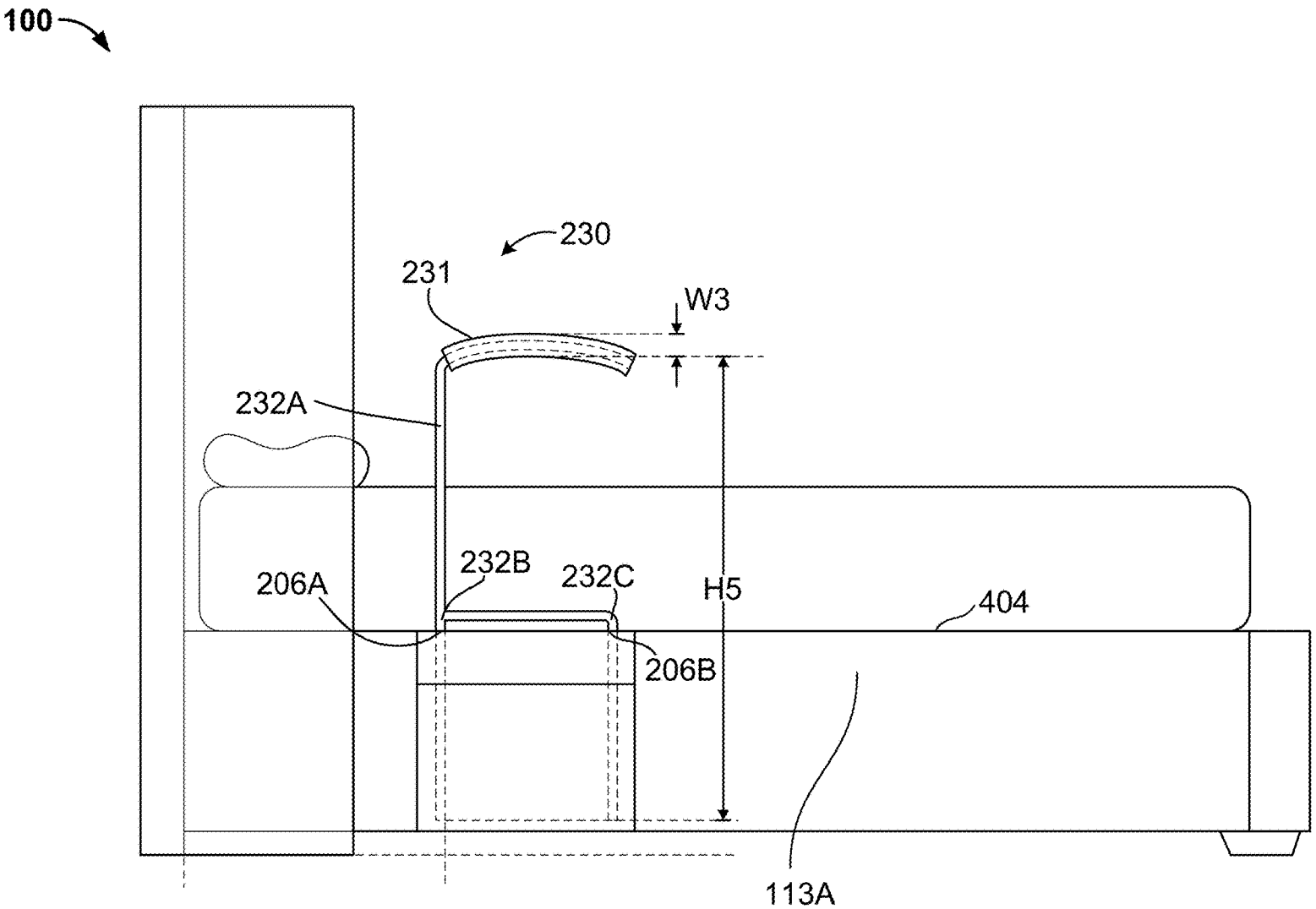
FIG. 2D is a side view of the bed system with another handle side rail accessory.

FIG. 2D is a side view of the bed system 100 with another handle accessory 230. The handle accessory 230 includes a handle 231. The handle 231 can be shaped like an arc. Moreover, the handle accessory 230 can have a support pole configuration with one support pole 232A connected to the handle 231 and with multiple support poles 232B and 232C splitting off of the support pole 232A and extending into the mounting holes 206A and 206B. In some implementations, any of the handle and/or tabletop accessories described herein can have one or two support poles. Although the handle accessory 230 has one support pole 232A, the support poles 232B and 232C can mount into the mounting holes 206A and 206B to provide structural support for the handle accessory 230 and any user who uses the handle accessory 230 to maneuver in and around the bed system 100. Like the support poles 204A and 204B, the support pole 232A can have the height H5. H5 can be a preferred height for assisting any type of user in maneuvering in and around the bed system 100. The handle 231 can have a width W3. W3 can be within a range of 20-80 mm. In some implementations, W3 can be the same as W2. In some implementations, as shown in FIG. 2D, W3 can be 50 mm. Similar to W2, W3 can be a sufficient width for providing adequate support to any type of user using the handle 231 to maneuver in and around the bed system 100.

Figure 2E:
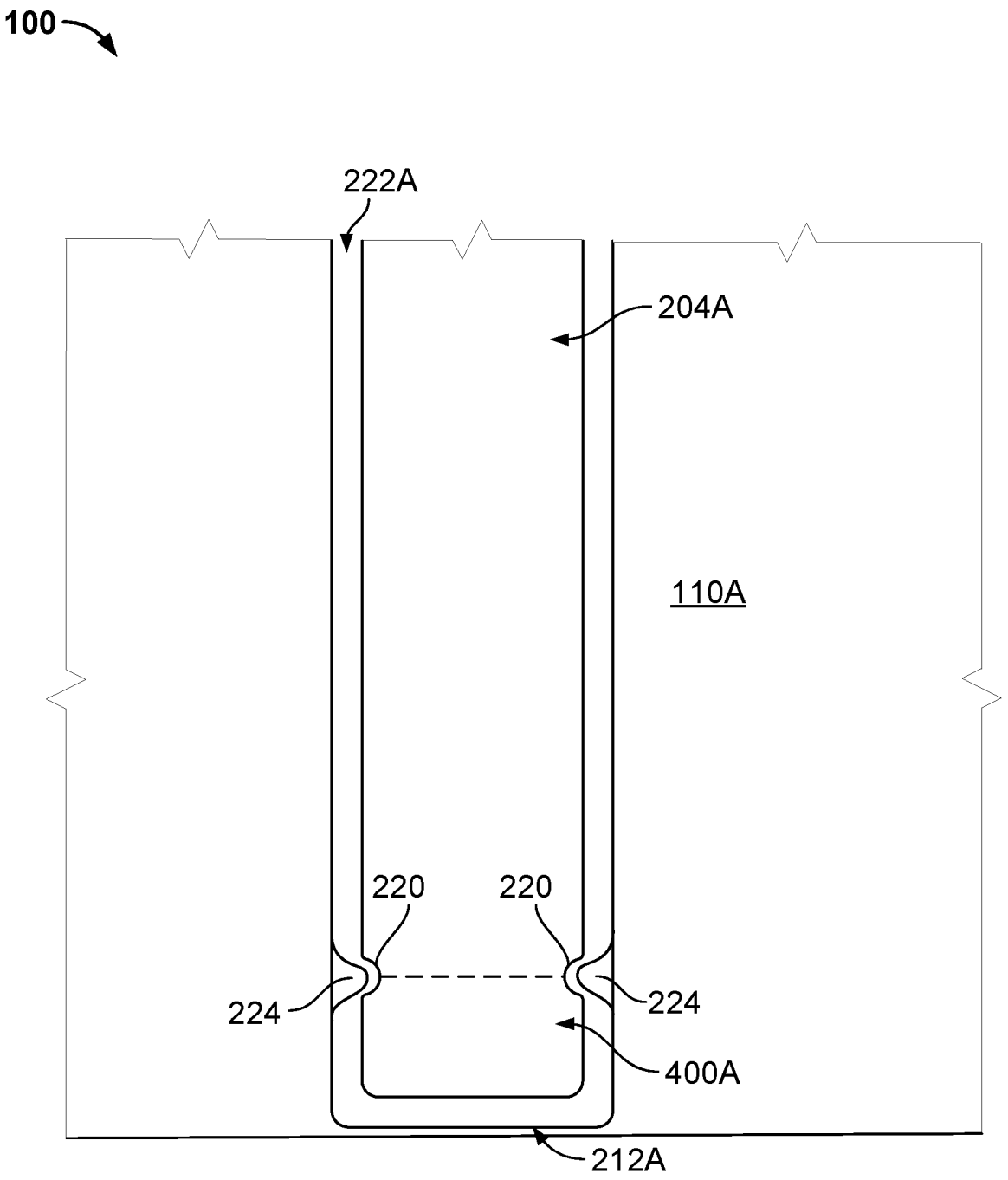
FIG. 2E depicts a schematic sectional view of a support pole mounted inside a cavity in a side rail of the bed system described herein.
Figure 2F:
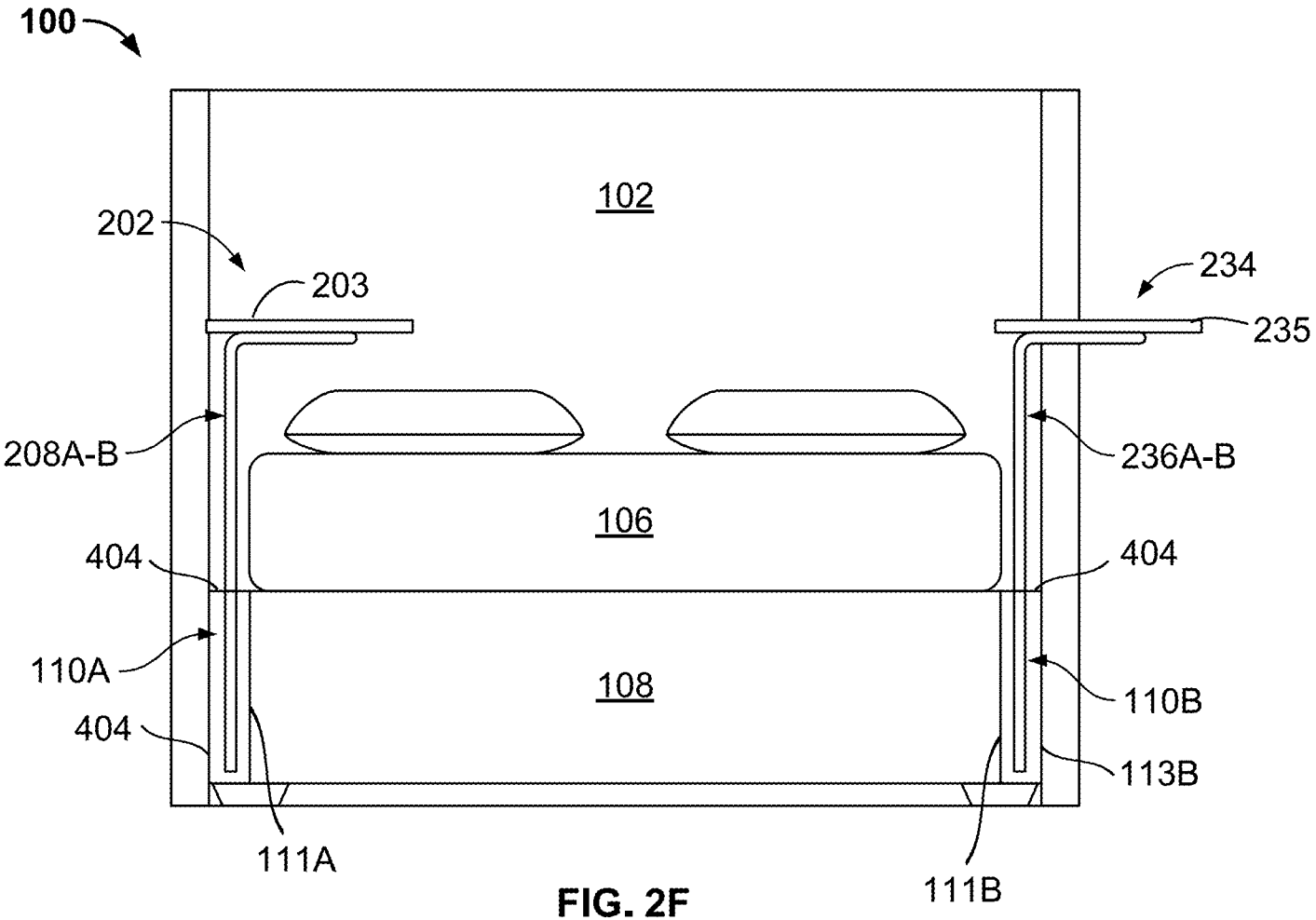
FIG. 2F depicts the bed system with reversible tabletop side rail accessories.

FIG. 2E depicts a schematic sectional view of the support pole 204A mounted inside the cavity 222A in the side rail 110A of the bed system 100. It shall be understood that the description of FIG. 2E also can apply to any of the other support poles described throughout this disclosure.

The bed system 100 can include a connector 224 positioned in the cavity 222A. The connector 224 can be configured to retain the support pole 204A inside the cavity 222A within the mounting hole 206A. The support pole 204A includes a connecting portion 400A that can extend to and touch the bottom 212A of the cavity 222A when retained within the cavity 222A. Moreover, the support pole 204A can define an indentation 220 at a distal end of the support pole 204A, proximate the connecting portion 400A. The connector 224 of the cavity 222A can mate with the indentation 220 of the support pole 204A to retain the support pole 204A securely in the cavity 222A.

FIG. 2F depicts the bed system 100 with reversible tabletop side rail accessories. Here, the support poles 208A and 208B of the tabletop accessory 202 are mounted in the side rail 110A of the bed system 100. Support poles 236A and 236B of tabletop accessory 234 are mounted in the side rail 110B of the bed system 100. Tabletops 203 and 235 can be the same tabletop design. In some implementations, the tabletops 203 and 235 can be different tabletop designs. FIG. 2F demonstrates bidirectional mounting capabilities of the tabletop accessories 202 and 234, as described throughout this disclosure. In other words, the tabletop accessories 202 and 234 are reversible, such that the tabletop 203 can be inward-facing over a portion of the mattress 106 and the tabletop 235 can be outward-facing away from the mattress 106 of the bed system 100. The user can reverse directionality of the tabletop accessories 202 and 234 to satisfy any of their needs and/or uses for these side rail accessories.

Figure 2G:
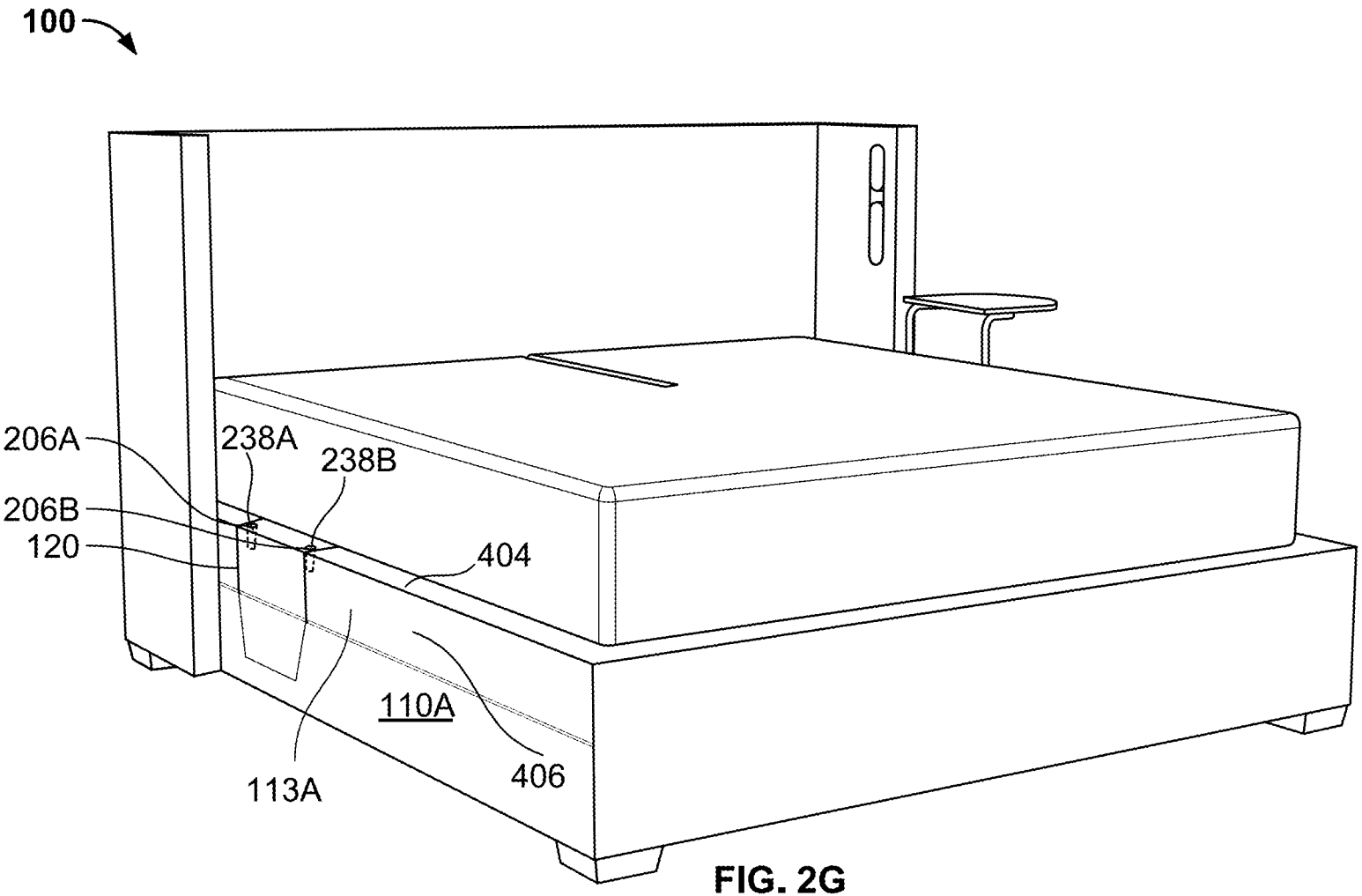
FIG. 2G depicts the bed system with a plate.

FIG. 2G depicts the bed system 100 with the plate 120. The plate 120 can extend a length and width over the top surface 404 of the side rail 110A such that the plate 120 covers the mounting holes 206A and 206B (not shown in FIG. 2G). The plate 120 can also extend a length down a side portion 406 of the side rail 110A (e.g., the outer surface 113A which is an external facing side of the side rail 110A). The plate 120 can be made of leather. The plate 120 can also have a plastic core and be wrapped in leather. In some implementations, the plate 120 can be made of a metal material. The metal material can include, but is not limited to, aluminum (e.g., anodized or not anodized), titanium, steel, zinc, chrome, and/or iron. The plate 120 can then be upholstered in fabric or left bare. The plate 120 can be another durable, sturdy, and esthetically pleasing material. As described herein, the plate 120 can also be a similar material, design, and/or pattern as upholstery material of the side rail 110A to improve aesthetic appearance of the bed system 100.

The plate 120 can include prongs 238A and 238B positioned on an underside of the plate 120. The prongs 238A and 238B can align with the mounting holes 206A and 206B. As a result, the prongs 238A and 238B can plug the respective mounting holes 206A and 206B when the prongs 238A and 238B are received by the mounting holes 206A and 206B. The prongs 238A and 238B can be equally sized to fit into either of the mounting holes 206A and 206B.

As described herein, the bed system 100 can be manufactured with the mounting holes 206A and 206B. When the user purchases the bed system 100, the plate 120 can come with the bed system 100. The user may optionally choose to purchase side rail accessories. If the user desires to purchase side rail accessories, then the user can easily remove the plate 120 to reveal the mounting holes 206A and 206B and attach the side rail accessories to the bed system 100 as described herein.

Figure 3A:
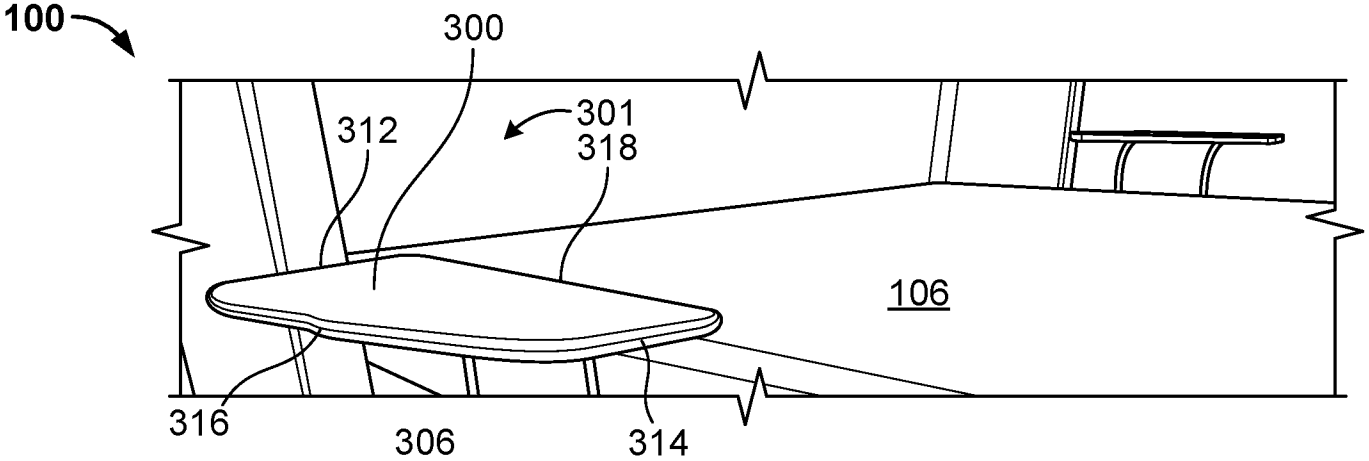
FIGS. 3A-B depict the bed system with tabletop side rail accessories.
Figure 3B:
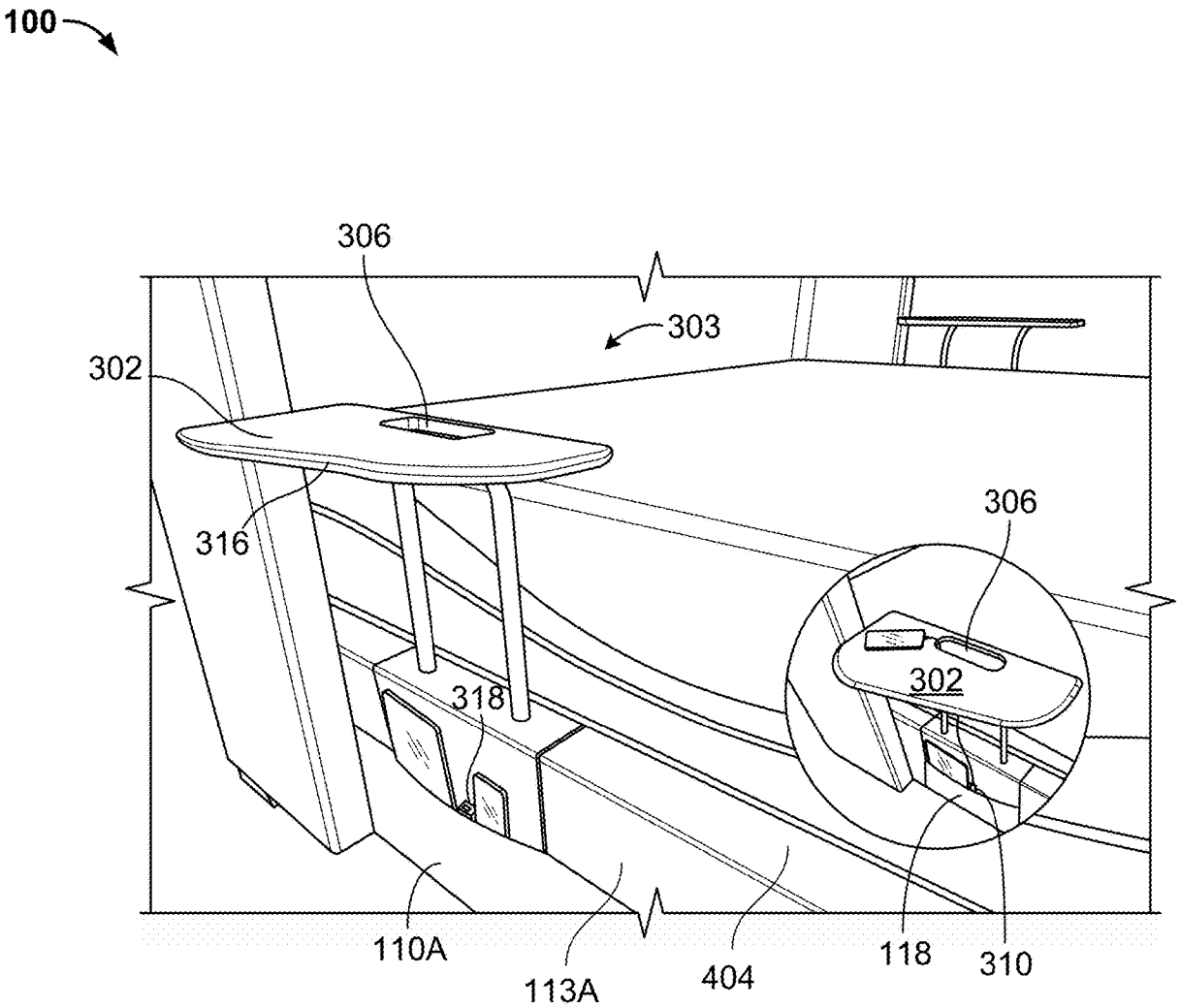

FIGS. 3A-B depict the bed system 100 with tabletop side rail accessories. As shown in FIGS. 3A-B and described herein, various tabletop accessories can be mounted to the bed system 100. For example, referring to FIG. 3A, tabletop accessory 301 can be mounted to the bed system 100. The tabletop accessory 301 can include a tabletop 300. The tabletop 300 can be made of a wood material. The tabletop 300 can be a dark wood with a grey satin lacquer for aesthetic appeal. The tabletop 300 can also have a wood core. The tabletop 300 can be shaped wider at a proximal end 312 than a distal end 314. Moreover, a side 316 of the tabletop 300 can have an asymmetrical curve shape. A side 318 of the tabletop 300 opposite the side 316 can be straight rather than curved. A shape of the tabletop 300 can be aesthetically pleasing and functional. The straight side 318 can be positioned adjacent to the mattress 106 so that the tabletop 300 does not interfere with the user's mobility while resting on the mattress 106. As described herein, the tabletop accessory 301 can also be reversibly mounted to the bed system 100. Thus, when reversibly mounted, the curved side 316 can extend over a portion of the mattress 106, thereby allowing the user to use the tabletop 300 while resting on the mattress 106.

Referring to FIG. 3B, tabletop accessory 303 can also be mounted to the bed system 100. The tabletop accessory 303 can include a tabletop 302. The tabletop 302 has a similar shape and material as the tabletop 300. However, the tabletop 302 includes an opening 306 closer to the straight side 318 than the curved side 316. The opening 306 can be sized to receive cables for charging user devices of the user of the bed system 100. The opening 306 can also be sized large enough that the user can reach their hand through the opening 306 and use the opening 306 as a grip to assist the user in maneuvering in and around the bed system 100. Thus, the tabletop 302 can be a discrete mobility aid.

The bed system 100 can include a pocket 118 integrated into the side rail 110A. The pocket 118 can be configured to hold items, such as mobile devices, laptops, magazines, books, etc. The pocket 118 can include at least one charging port 318, which can provide wired charging capabilities to user devices of the user. The charging port 318 can be a USB and/or a USC port. One or more other charging ports can also be included in the pocket 118. The user can plug a cable (e.g., wire) into the charging port 318, run the cable through the opening 306 and then attach to a user device resting on top of the tabletop 302 or otherwise on top of the mattress 106.

Figure 4:
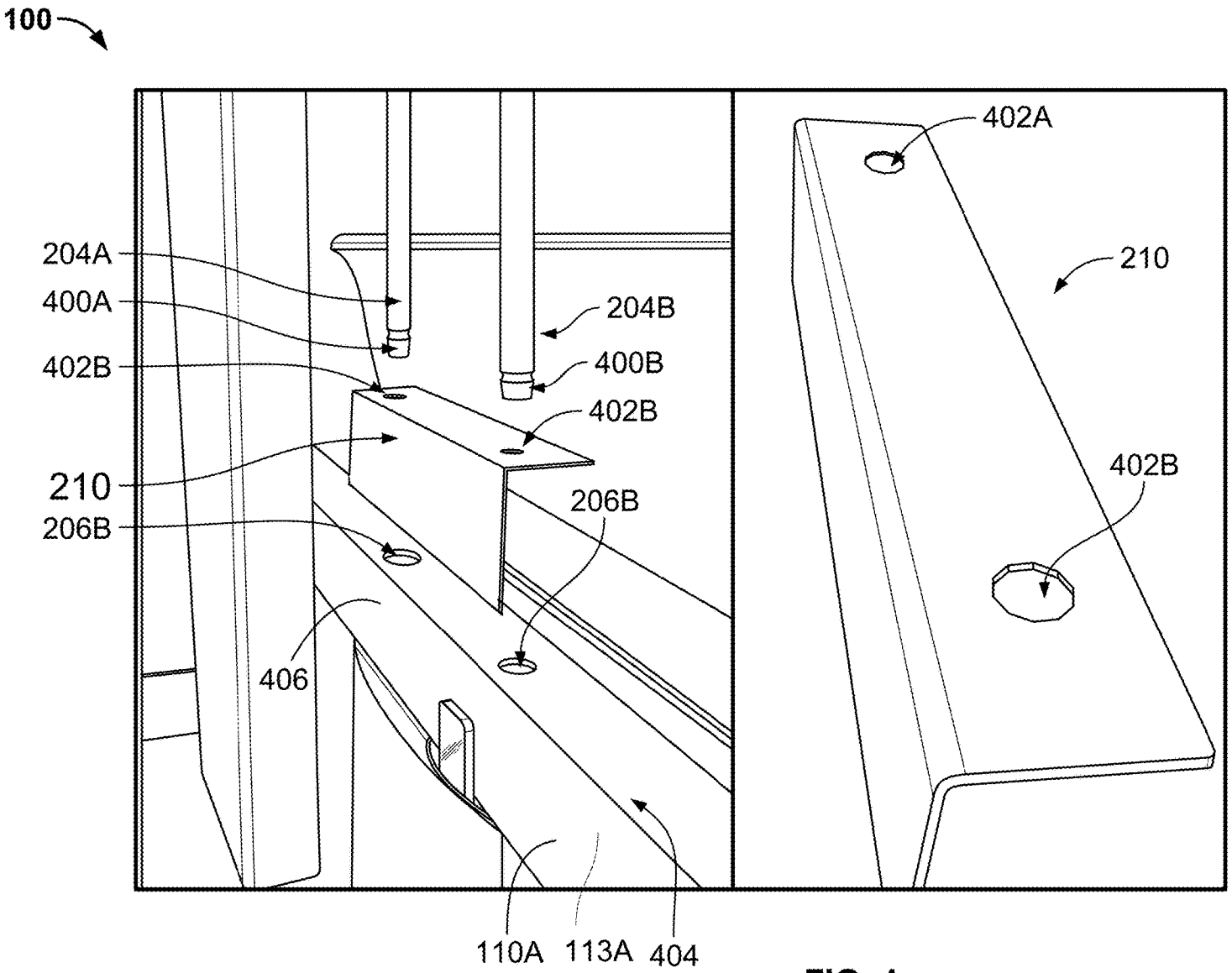
FIG. 4 depicts components for mounting a side rail accessory to a side rail of the bed system.
Figure 5:
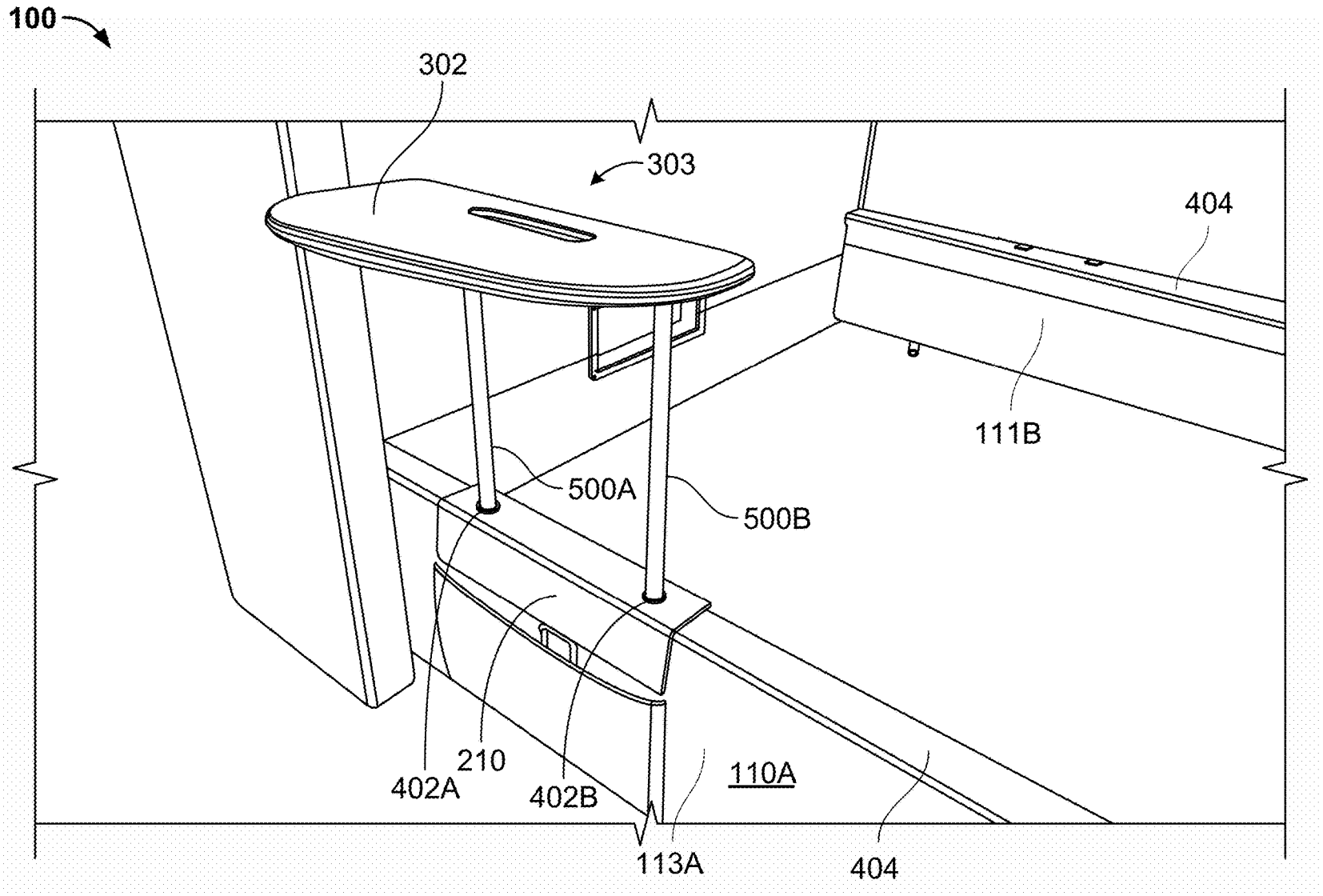
FIG. 5 depicts a tabletop side rail accessory mounted to the bed system.

FIG. 4 depicts components for mounting a side rail accessory to a side rail 110A of the bed system 100. The rail cover 210 can extend a length and width over the top surface 404 of the side rail 110A. The rail cover 210 can also extend a length down the side surface 406 of the side rail 110A. The rail cover 210 can include receiving holes 402A and 402B that can be configured to align with the respective mounting holes 206A and 206B of the side rail 110A. Therefore, the receiving holes 402A and 402B can be a same or similar size as the mounting holes 206A and 206B. As described herein, the receiving holes 402A and 402B can be configured to receive the connecting portions 400A and 400B and the support poles 204A and 204B so that a respective side rail accessory can be mounted to and supported by the side rail 110A of the bed system 100.

As described herein, the rail cover 210 can be a leather material. The rail cover 210 can be other sturdy and durable material that can be aesthetically pleasing. The rail cover 210 may also be a similar or same pattern/texture as the side rail 110A such that the rail cover 210 and side rail 110A blend together to create a cohesive and aesthetically appealing appearance of the bed system 100. Additionally, the rail cover 210 can be used in combination with any of the support poles and side rail accessories described throughout this disclosure to provide a more aesthetically pleasing appearance of the bed system 100 with one or more side rail accessories.

FIG. 5 depicts the tabletop accessory 303 mounted to the bed system 100. Here, the tabletop accessory 303 of FIG. 3 includes support poles 500A and 500B. The support poles 500A and 500B are received into the respective receiving holes 402A and 402B of the rail cover 210 to then extend into the side rail 110A of the bed system 100. As a result, the tabletop accessory 303 can be securely mounted to the bed system 100. The rail cover 210 is also used to provide a more cohesive and aesthetically pleasing appearance of the tabletop accessory 303 as it is attached to the side rail 110A of the bed system 100.

Figure 6:
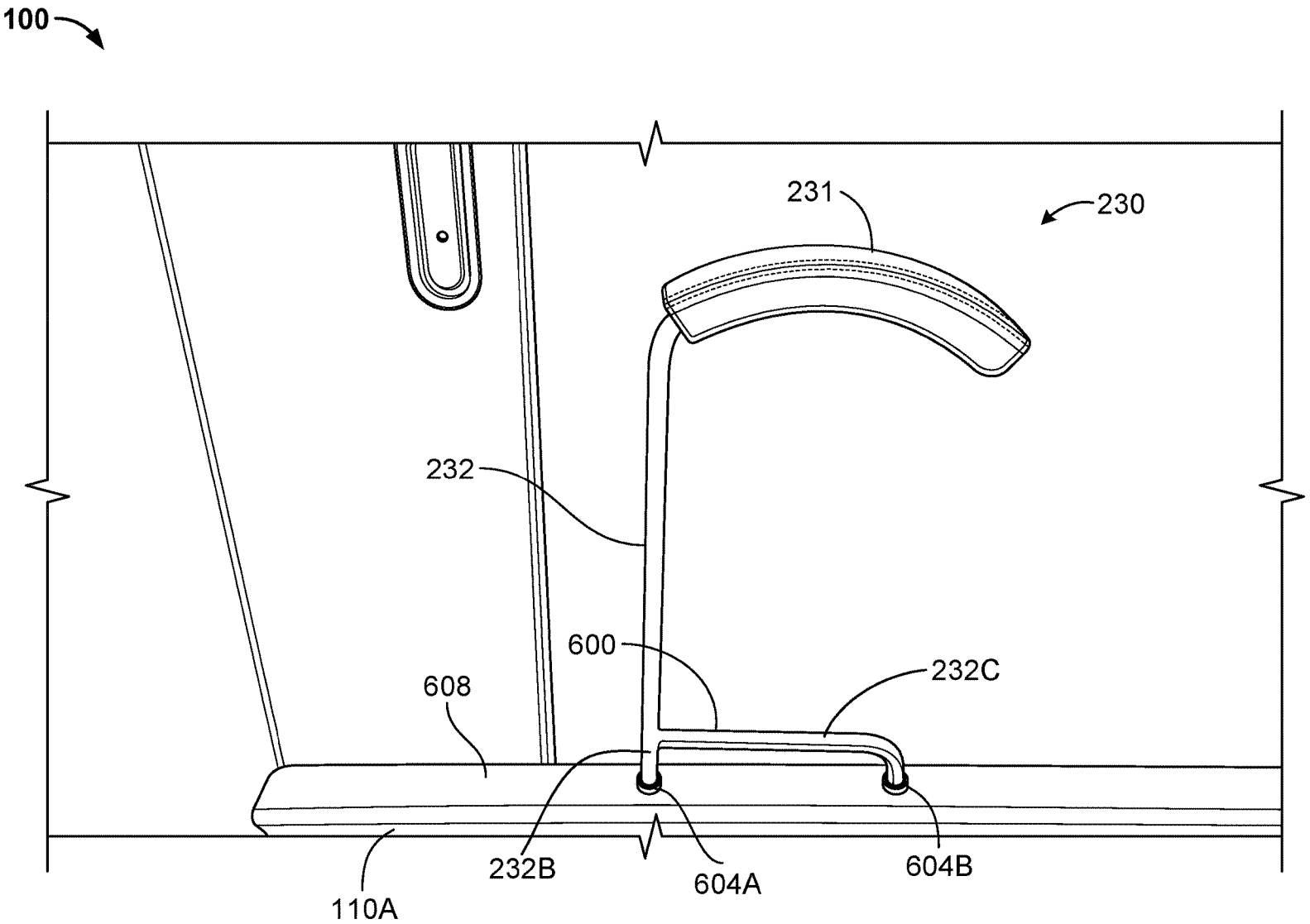
FIG. 6 depicts a handle side rail accessory mounted to the bed system.

FIG. 6 depicts the handle accessory 230 mounted to the bed system 100. Here, the handle accessory 230 of FIG. 2D is mounted to the side rail 110B of the bed system 100. The handle accessory 230 includes the handle 231 and the support pole 232A. The support pole 232A has a support bar 600 at a distal end of the support pole 232A opposite an end of the support pole 232A that connects to the handle 231. The support bar 600 can include the support poles 232B and 232C, which can be received into mounting holes 604A and 604B on a top surface 608 of the side rail 110B to provide structural support to the handle accessory 230. The mounting holes 604A and 604B can be the same as the mounting holes 206A and 206B described throughout this disclosure. In this example, a rail cover (e.g., the rail cover 210) is not used. However, in some implementations, a user can use the rail cover in addition to the handle accessory 230.

The handle 231 can be made with a foam batten layer to provide support, comfort, and cushion to a user of the bed system 100, thereby making the handle 231 easy to grip and use for maneuvering in and around the bed system 100. The handle 231 can further be bolstered in a leather material that is both aesthetically pleasing and comfortable to hold by users.

Figure 7:
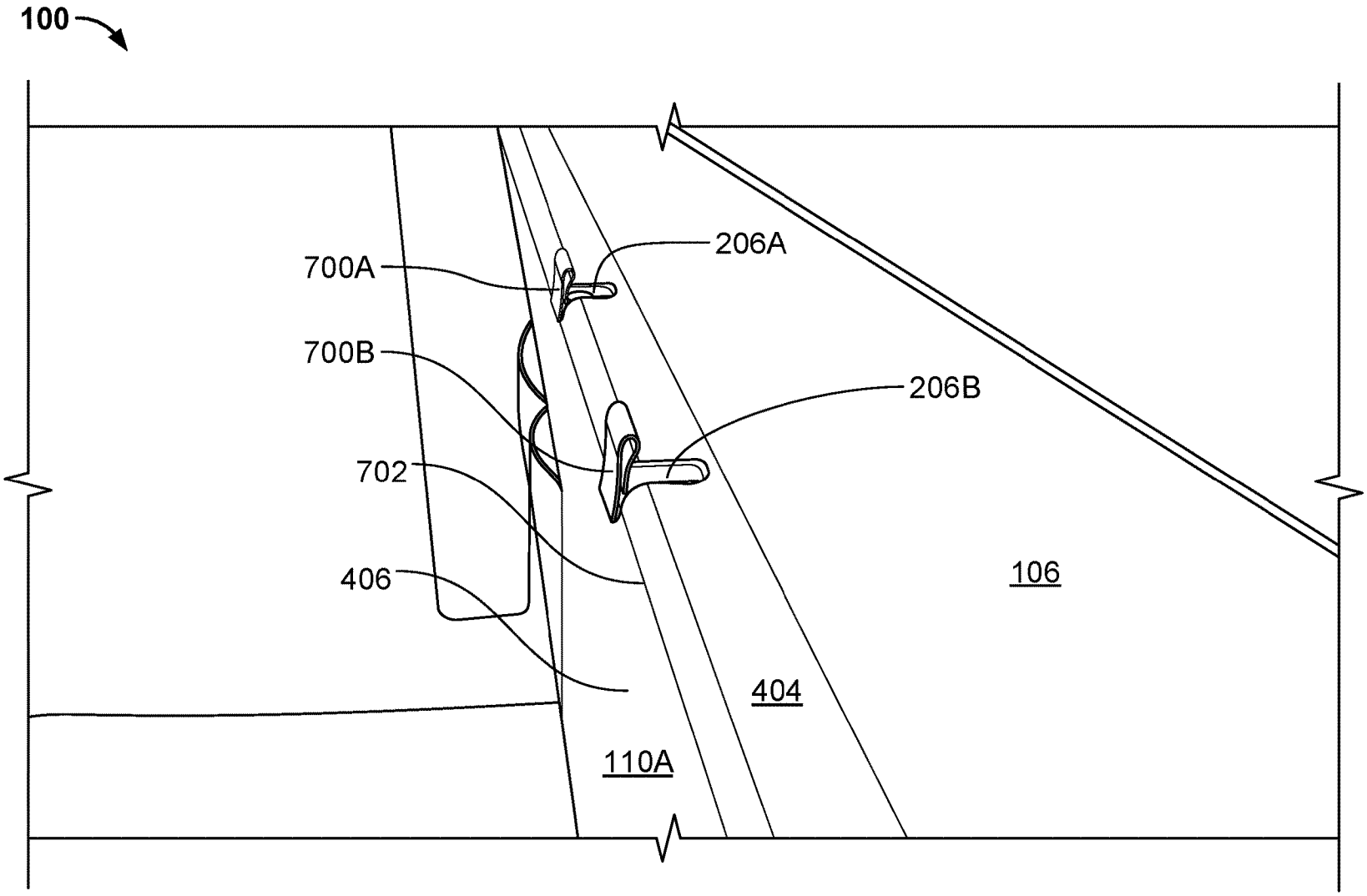
FIG. 7 depicts one embodiment of the mounting holes on a side rail of the bed system.

FIG. 7 depicts one embodiment of the mounting holes 206A and 206B on a side rail 110A of the bed system 100. In this example of the bed system 100, fabric panels 700A and 700B can be integrated into an external facing edge 702 of the side rail 110A where the top surface 404 (e.g., top portion) and the side surface 406 (e.g., external facing side) of the side rail 110A join. The fabric panels 700A and 700B can be configured to fold over the respective mounting holes 206A and 206B when they are not holding support poles of a side rail accessory. In other words, the fabric panels 700A and 700B can be sized and configured to cover the mounting holes 206A and 206B when support poles are not positioned therein.

The bed system 100 can be made with the fabric panels 700A and 700B. The fabric panels 700A and 700B can be used to cover the mounting holes 206A and 206B instead of the plate 120 described throughout this disclosure. The fabric panels 700A and 700B can include hook-and-loop fasteners or similar fasteners to retain the fabric panels 700A and 700B to the mounting holes 206A and 206B when they do not receive support poles. This configuration can be aesthetically appealing and easy to use by a user of the bed system 100. Moreover, the fabric panels 700A and 700B can be made of a same upholstery material as the side rail 110A so that the fabric panels 700A and 700B blend in with the side rail 110A and create a cohesive and aesthetic appearance.

Figure 8A:
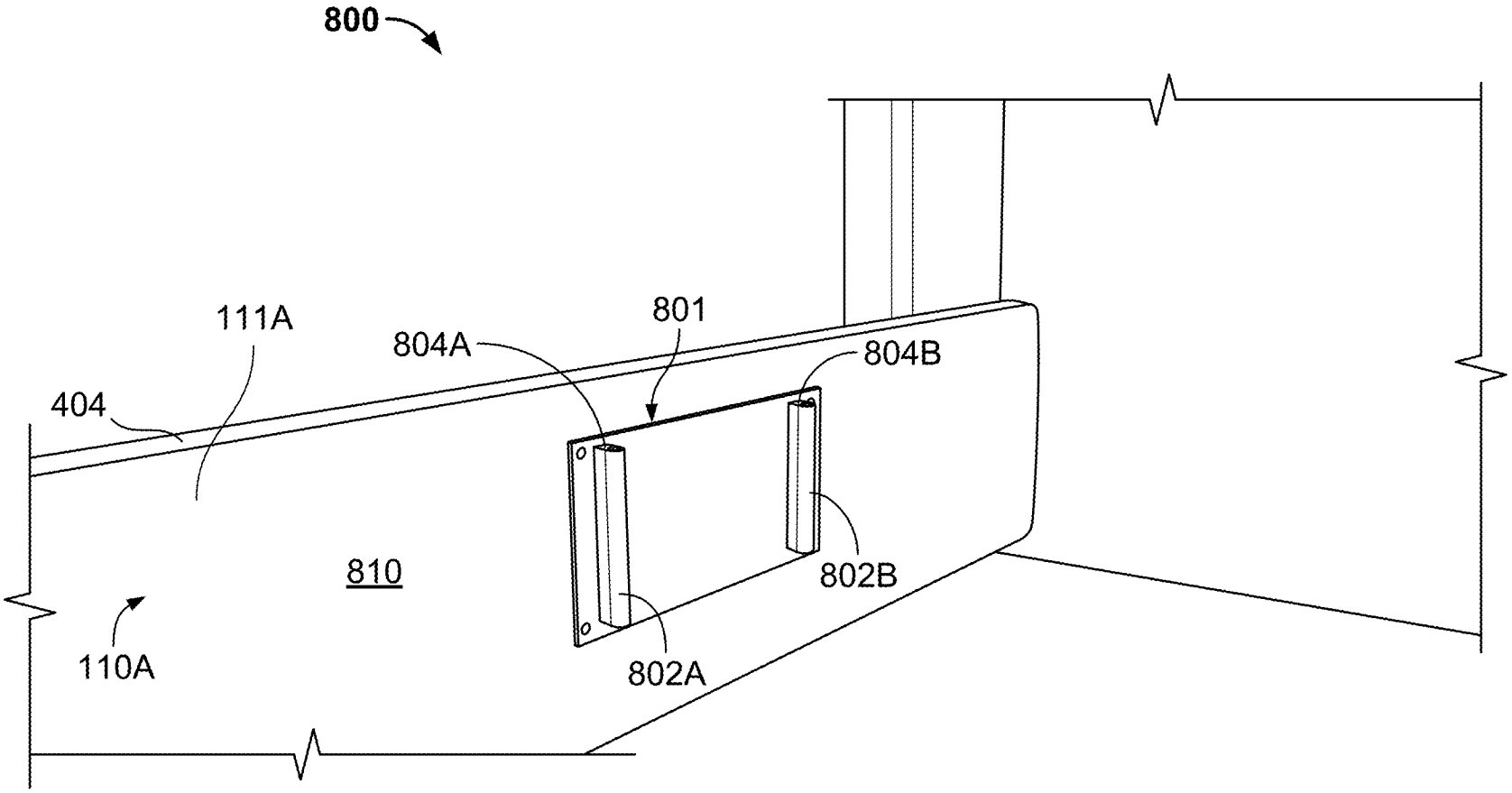
FIGS. 8A-B depict an alternative bed system.
Figure 8B:
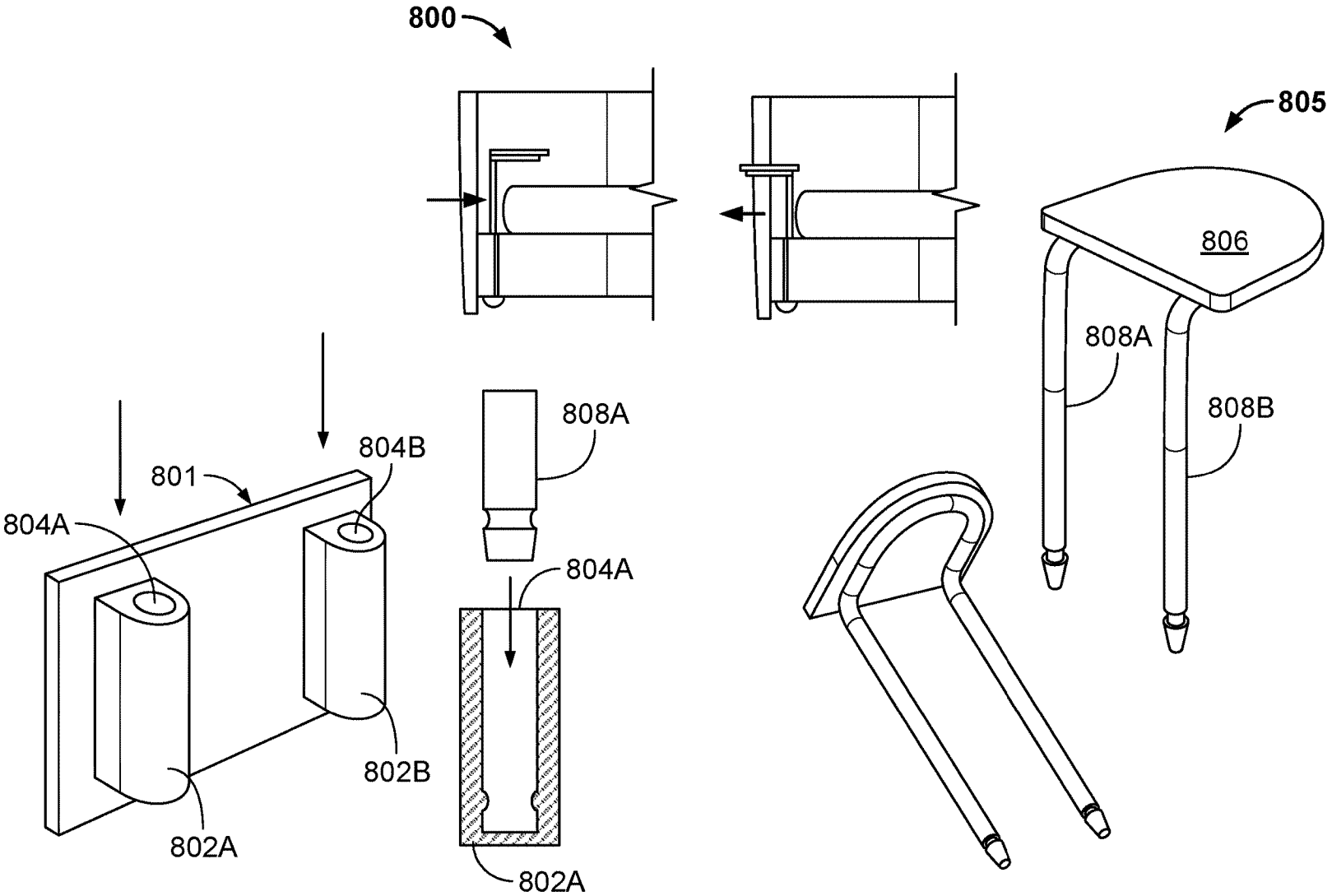

FIGS. 8A-B depict an alternative bed system 800. The bed system 801 can be similar to the bed system 100 except that the bed system 801 includes an example mounting plate 801 for attaching side rail accessories to the bed system 800. As shown in FIG. 8A, the mounting plate 801 can be connected to an inner facing side 810 (i.e., the inner surface 111A) of the side rail 110A. The mounting plate 801 can be bolted, screwed, or adhered into the inner facing side 810 of the side rail 110A. The mounting plate 801 can be made of a sturdy and durable material, such as a lightweight metal material.

The mounting plate 801 can include support tubes 802A and 802B that can be sized to receive support poles of side rail accessories. The support tubes 802A and 802B can include respective mounting holes 804A and 804B for receiving the support poles of the side rail accessories.

Referring to FIG. 8B, a tabletop accessory 805 can include a tabletop 806 and support poles 808A and 808B. The support poles 808A and 808B can be received in either of the mounting holes 804A and 804B of the respective support tubes 802A and 802B (e.g., refer to FIG. 2E for further discussion), allowing for the tabletop accessory 805 to be reversibly attached to the bed system 800 as described above. The other side rail accessories described throughout this disclosure can also be mounted to the bed system 800 using the mounting plate 801.

Figure 9A:
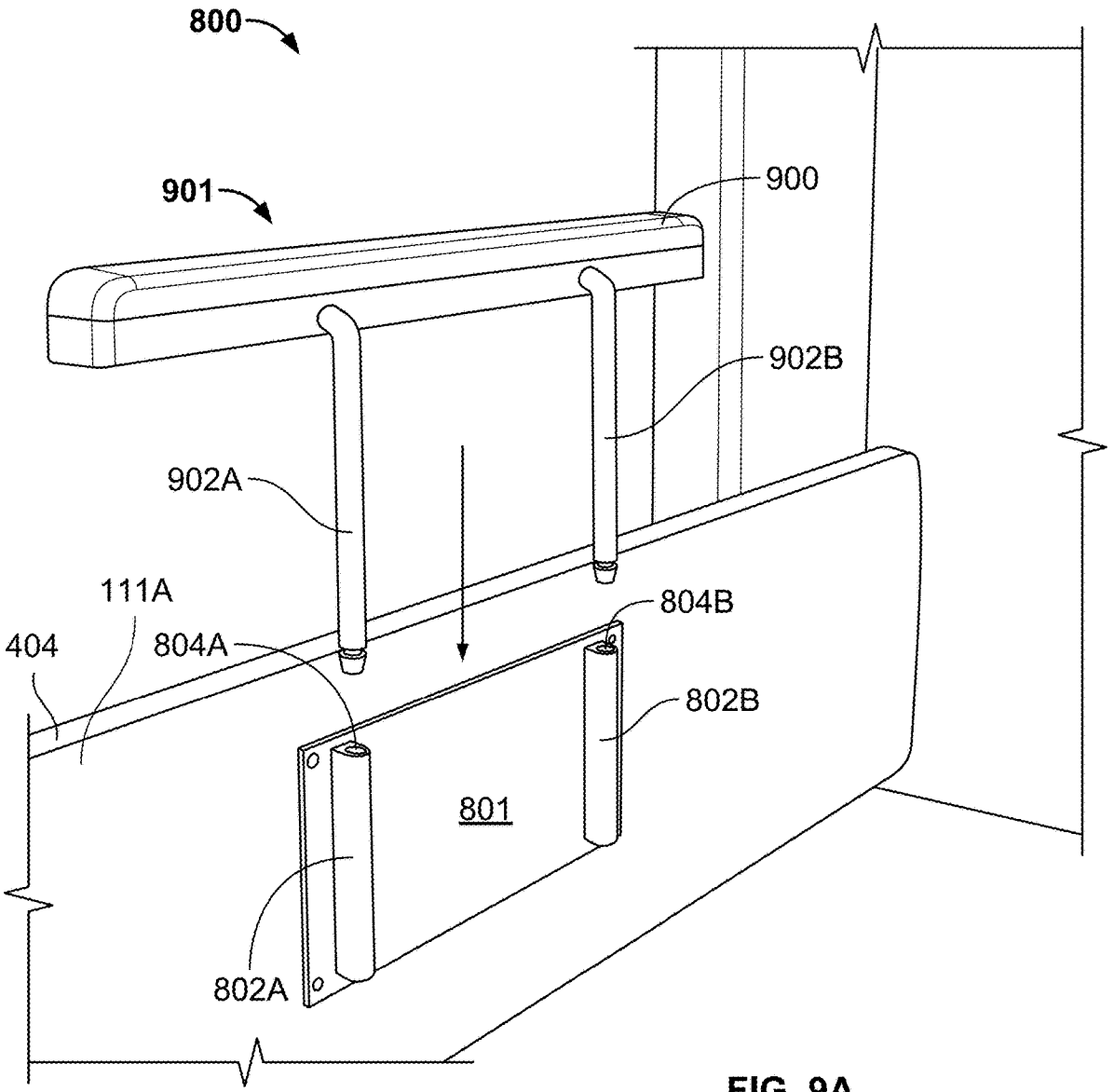
FIGS. 9A-C depict attaching a handrail to the bed system using the mounting plate.
Figure 9B:
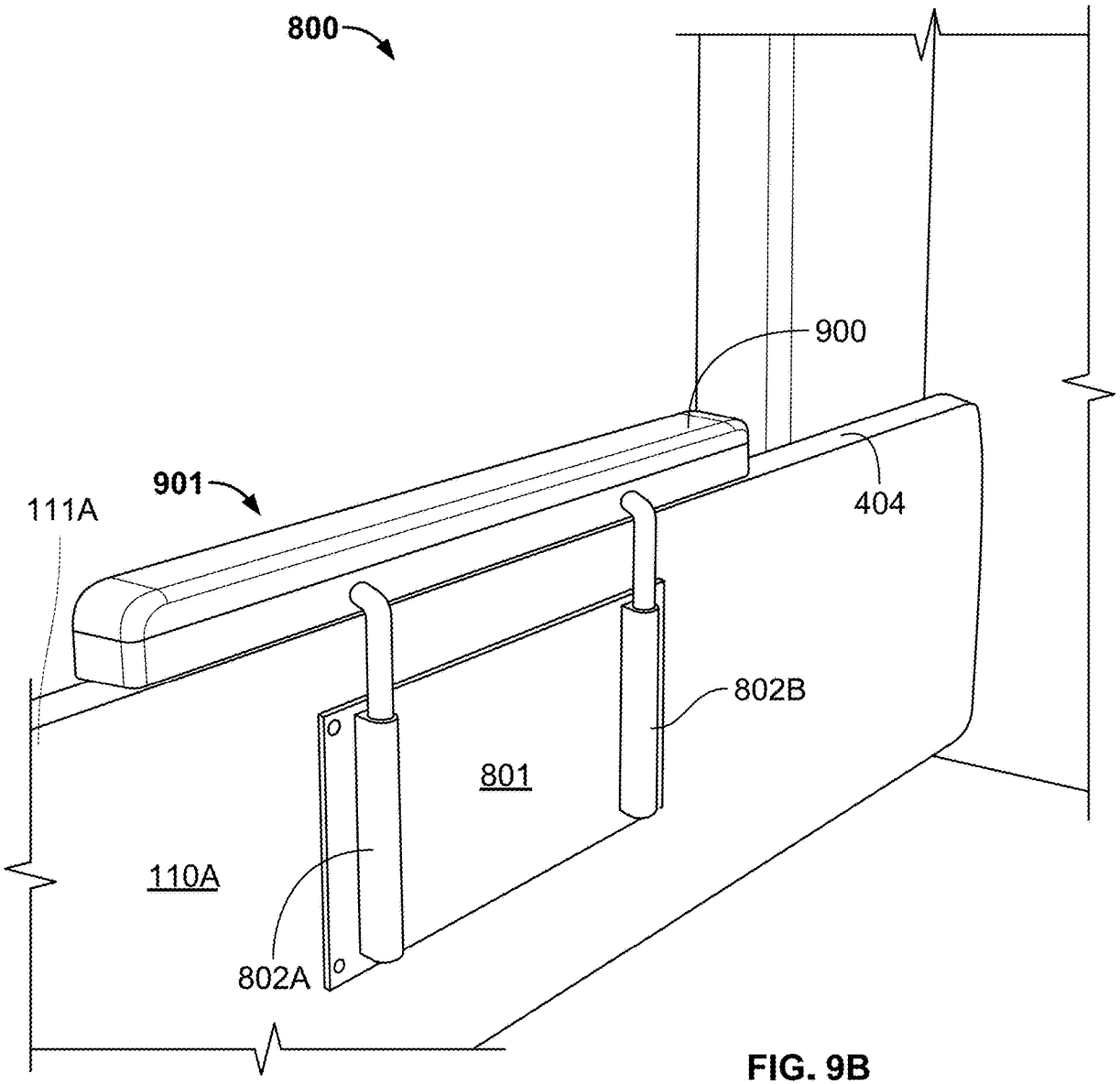
Figure 9C:
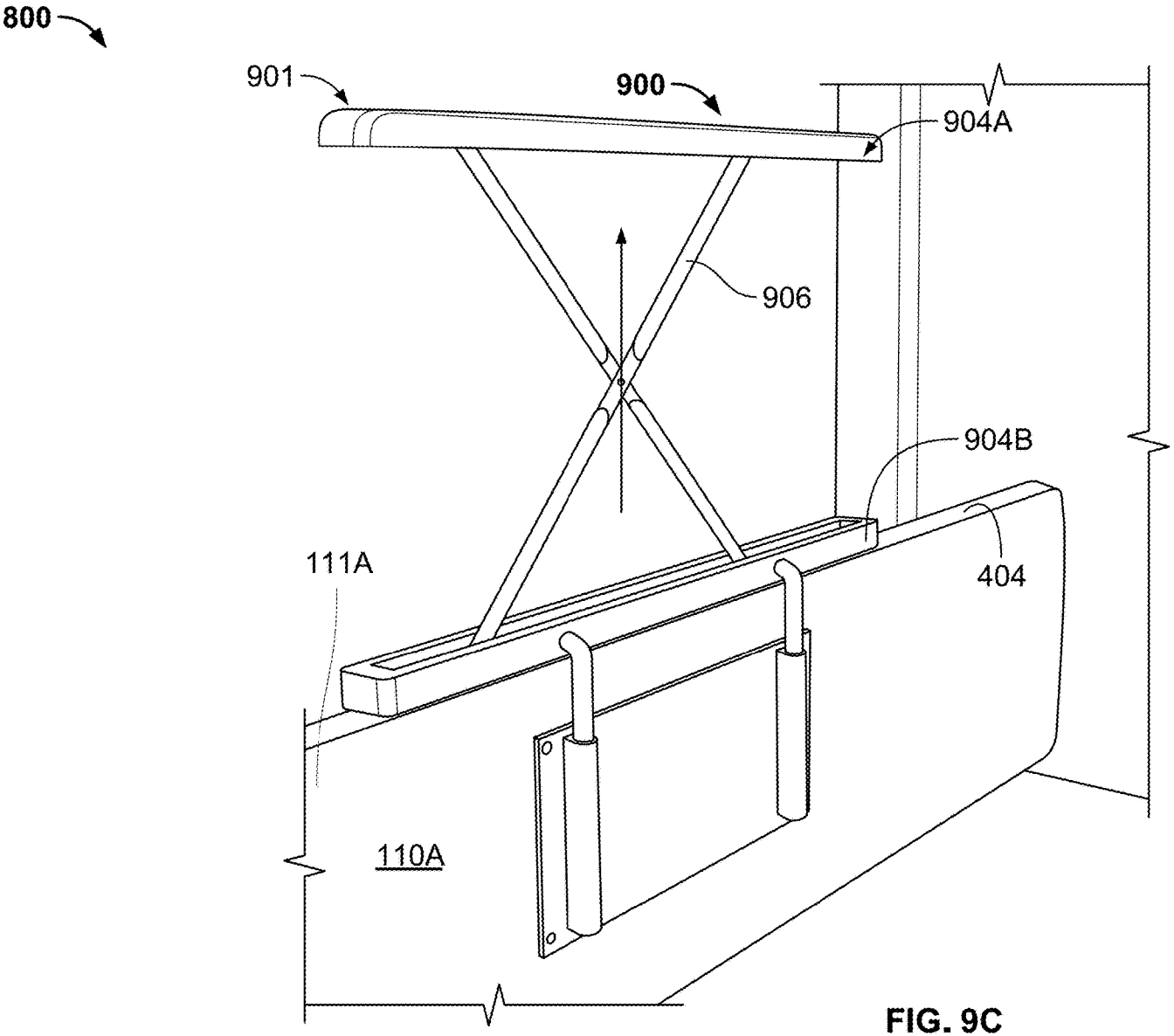

FIGS. 9A-C depict attaching a handrail accessory 901 to the bed system 800 using the mounting plate 801. The handrail accessory 901 can include a handrail 900 and support poles 902A and 902B. As shown in FIG. 9A, the support poles 902A and 902B can be received through the mounting holes 804A and 804B of the mounting plate 801 and into the respective support tubes 802A and 802B. Once the support poles 902A and 902B click into support tubes 802A and 802B of the mounting plate 801 (e.g., refer to FIG. 2E), the handrail 900 of the handrail accessory 901 can rest on the top surface 404 of the side rail 110A, as shown in FIG. 9B. A user of the bed system 800 can then pull up on a top portion 904A of the handrail 900 to extend a handrail structure 906 out from a bottom portion 904B of the handrail 900, where the bottom portion 904B of the handrail 900 remains flush with the top surface 404 of the side rail 110A. Refer to FIG. 9C. The handrail structure 906 can click into a secured/locked position once the handrail structure 906 is extended to a full height. The top portion 904A of the handrail 900 can thus be raised to the fully extended height so that the handrail accessory 901 can be used as a mobility aid to the user of the bed system 800.

Figure 10:
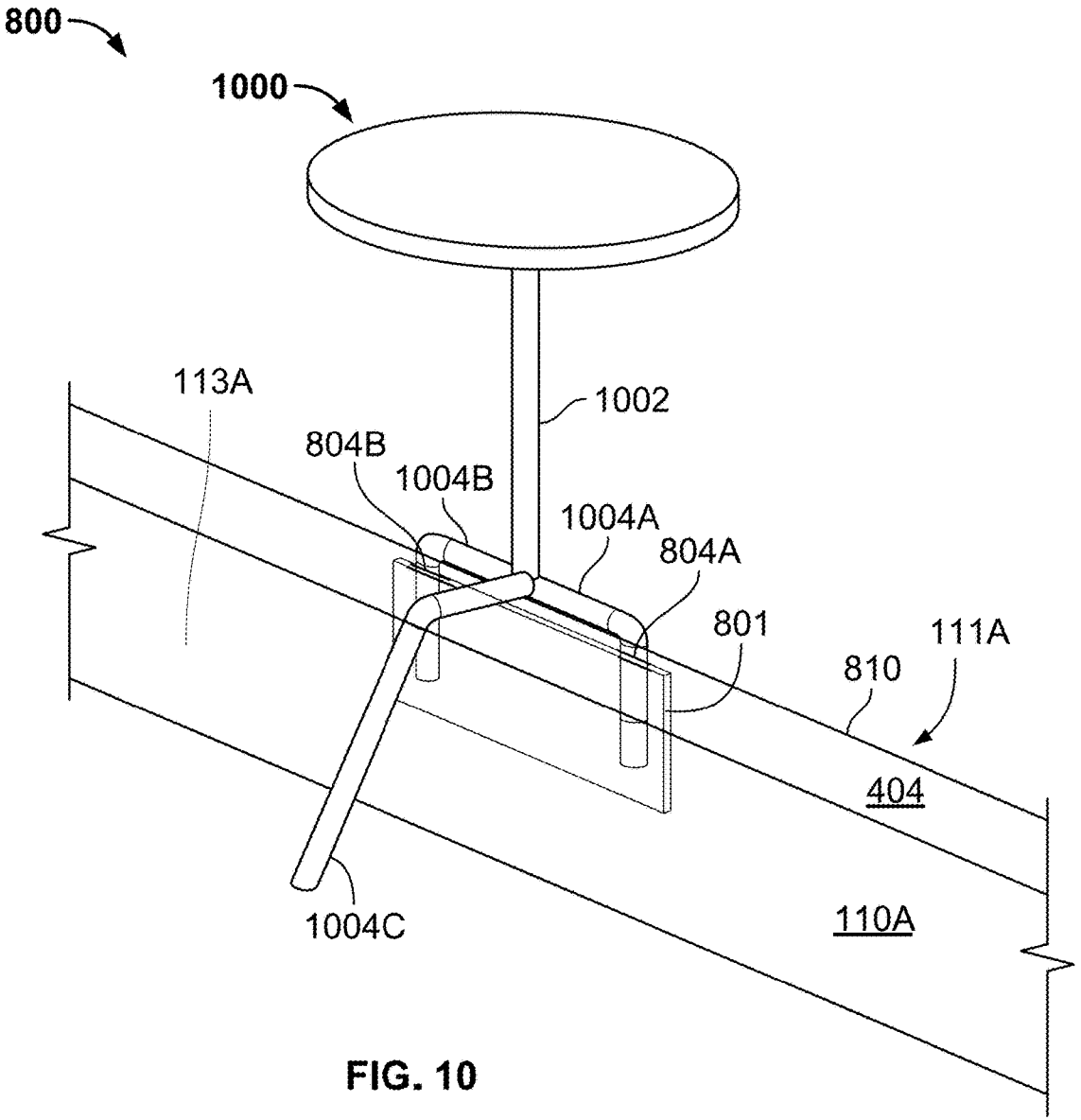
FIG. 10 depicts a tabletop attached to the bed system using the mounting plate.

FIG. 10 depicts a tabletop accessory 1000 attached to the bed system 800 using the mounting plate 801. As shown and described herein, the mounting plate 801 is mated to the inner facing side 810 (i.e., the inner surface 111A) of the side rail 110A. The tabletop accessory 1000 includes a leg 1002 that includes three support poles 1004A, 1004B, and 1004C. The support poles 1004A and 1004B can be received through the mounting holes 804A and 804B of the mounting plate 801. The support pole 1004C can be configured to extent over the top surface 404 of the side rail 110A so that the support pole 1004C can connect with a ground surface on which the bed system 800 rests. As a result, the support pole 1004C can provide additional structural support to the tabletop accessory 1000.

Figure 11:
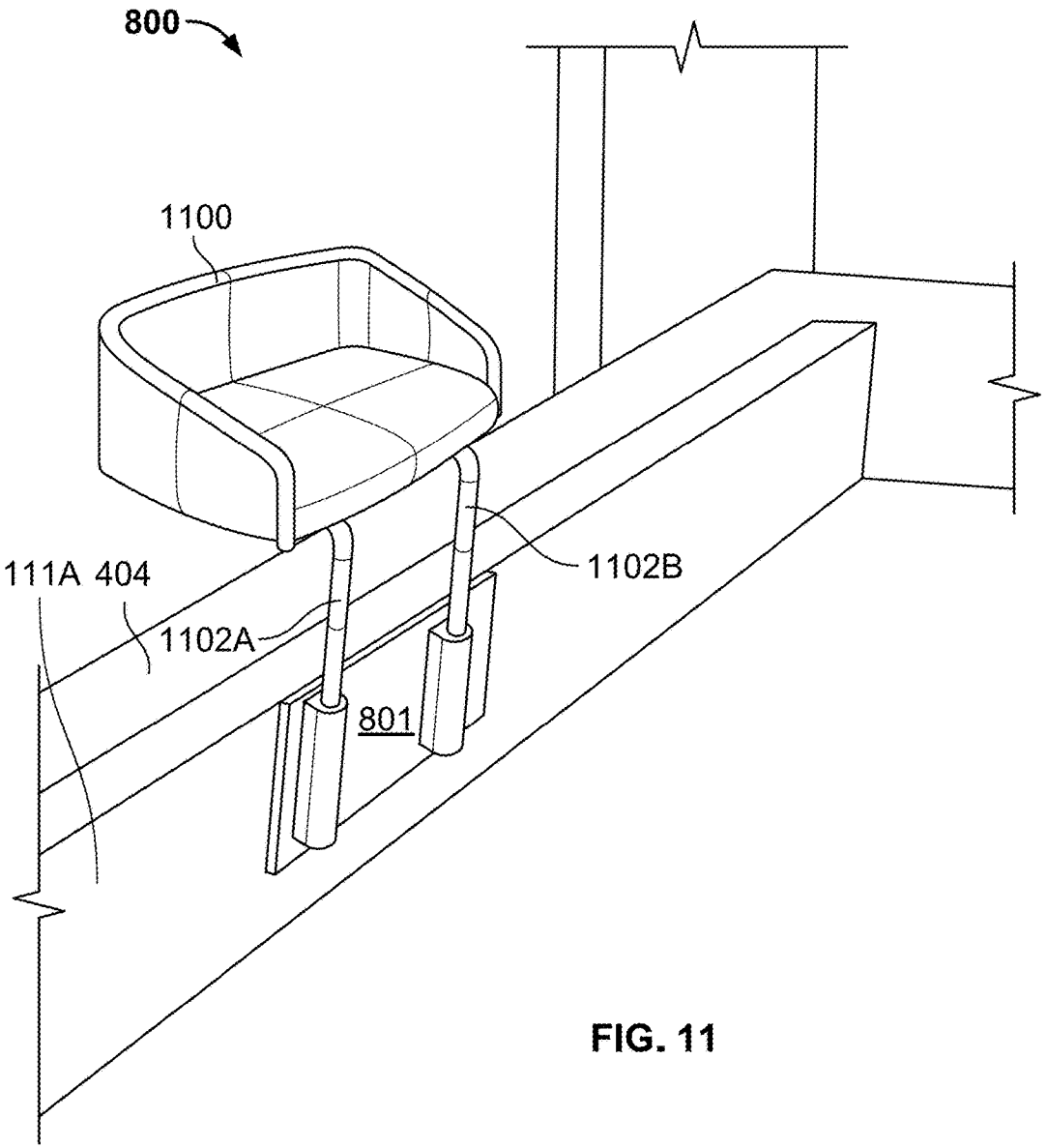
FIG. 11 depicts a bassinet attached to the bed system using the mounting plate.

FIG. 11 depicts a bassinet accessory 1100 attached to the bed system 800 using the mounting plate 801. The bassinet accessory 1100 includes support poles 1102A and 1102B. The support poles 1102A and 1102B can be retained in the mounting plate 801 as described above. As a result, the bassinet accessory 1100 can be positioned at a side of the bed system 800 so that a user of the bed system 800, such as a mother, can take care of their child in the bassinet accessory 1100 while in the bed system 800.

Although many of the features and components of a side rail accessory are described in a configuration that includes one side rail, such as the side rail 110A of the bed system 100, the features and components described herein can also be configured to other side rails of bed systems, including but not limited to the side rail 110B of the bed system 100.

Therefore, the disclosed techniques are not limited to one side rail of a bed system but instead are applicable to both side rails of a bed system.

FIGS. 12A-E depict another example handle side rail accessory 1200 for the bed system 100 described herein. Referring to FIGS. 12A-D, the handle side rail accessory 1200 is similar to the handle accessory 200 described in reference to FIG. 2C. For example, a handle 1202 of the accessory 1200 is similar to the handle 201 of the handle accessory 200 in that the handle 1202 is shaped as a half hexagon, or partial hexagon, arm design. The handle 1202 can have similar or the same measurements as the handle 201 described in FIG. 2C. Moreover, the handle 1202 can have curved first and second ends 1204A and 1204B, respectively. The curved first and second ends 1204A and 1204B can provide ease of use for users of the bed system 100 when getting in and out of the bed system 100. The curved first and second ends 1204A and 1204B can also provide better fit with the bed system 100 when the bed system 100 is adjusted/articulated.

The handle side rail accessory 1200 also includes support poles 1206A and 1206B. The support poles 1206A and 1206B can be similar to the support poles 204A and 204B described in reference to FIG. 2C. The support poles 1206A and 1206B can bend towards the mattress 106 where the support poles 1206A and 1206B enter the side rail 110A of the foundation 108 of the bed system 100, as shown in FIGS. 12B, 12C, and 12D. More particularly, referring to FIGS. 12B, 12C, and 12D, portions 1214A and 1214B of the respective support poles 1206A and 1206B bend towards the mattress 106. The support poles 1206A and 1206B include respective connecting portions 1220A and 1220B that enter the side rail 110A through mounting holes 1218A and 1218B to secure the accessory 1200 in place when connected to the bed system 100. The connecting portions 1220A and 1220B are similar or the same as the connecting portion 400A described herein. The mounting holes 1218A and 1218B are similar or the same as the mounting holes 206A and 206B described herein. In some implementations, as shown in FIG. 12B, a plate 1216 can also extend over a portion of the side rail 110A where the support poles 1206A and 1206B of the accessory 1200 connect/mount to the bed system 100. The plate 1216 can be similar or the same as the plate 120 described throughout this disclosure. Refer to FIGS. 2A, 2E, and 2G for further discussion.

The bend in the support poles 1206A and 1206B and the portions 1214A and 1214B of the support poles 1206A and 1206B, respectively, provides numerous benefits. For example, the bend in the support poles 1206A and 1206B can prevent or reduce the chance of the mattress 106 hitting or otherwise coming into contact with the accessory 1200 when the bed system 100 is adjusted. Moreover, the bend in the support poles 1206A and 1206B can make it easier for the user to get in and out of the bed system 100.

Still referring to FIGS. 12A-D, the handle side rail accessory 1200 can include horizontal support poles 1208A and 1208B. The horizontal support poles 1208A and 1208B can connect or otherwise attach to the support poles 1206A and 1206B to provide structural support to the accessory 1200. The horizontal support poles 1208A and 1208B can also be used to extend a wrap material 1210 across a gap created by and between the support poles 1206A and 1206B. The wrap material 1210 can be removable. In some implementations, the wrap material 1210 may not extend across the gap created by and between the support poles 1206A and 1206B. In other words, for some embodiments the wrap material 1210 may not be included as part of the accessory 1200, as shown in FIG. 12D.

The wrap material 1210 can provide benefits such as improving safety of using the handle side rail accessory 1200 with the bed system 100 and preventing or reducing injury to the bed users. For example, the wrap material 1210 can be used to deter or prevent the user's body parts or other materials or objects from getting stuck between the support poles 1206A and 1206B, the mattress 106, the foundation 108, or any other part of the bed system 100, especially when the foundation 108 is being articulated/adjusted and the mattress 106 is raising and lowering. In some implementations, the wrap material 1210 can be made of leather. The wrap material 1210 can also be made of one or more fabrics or other materials described throughout this disclosure.

Figure 12A:
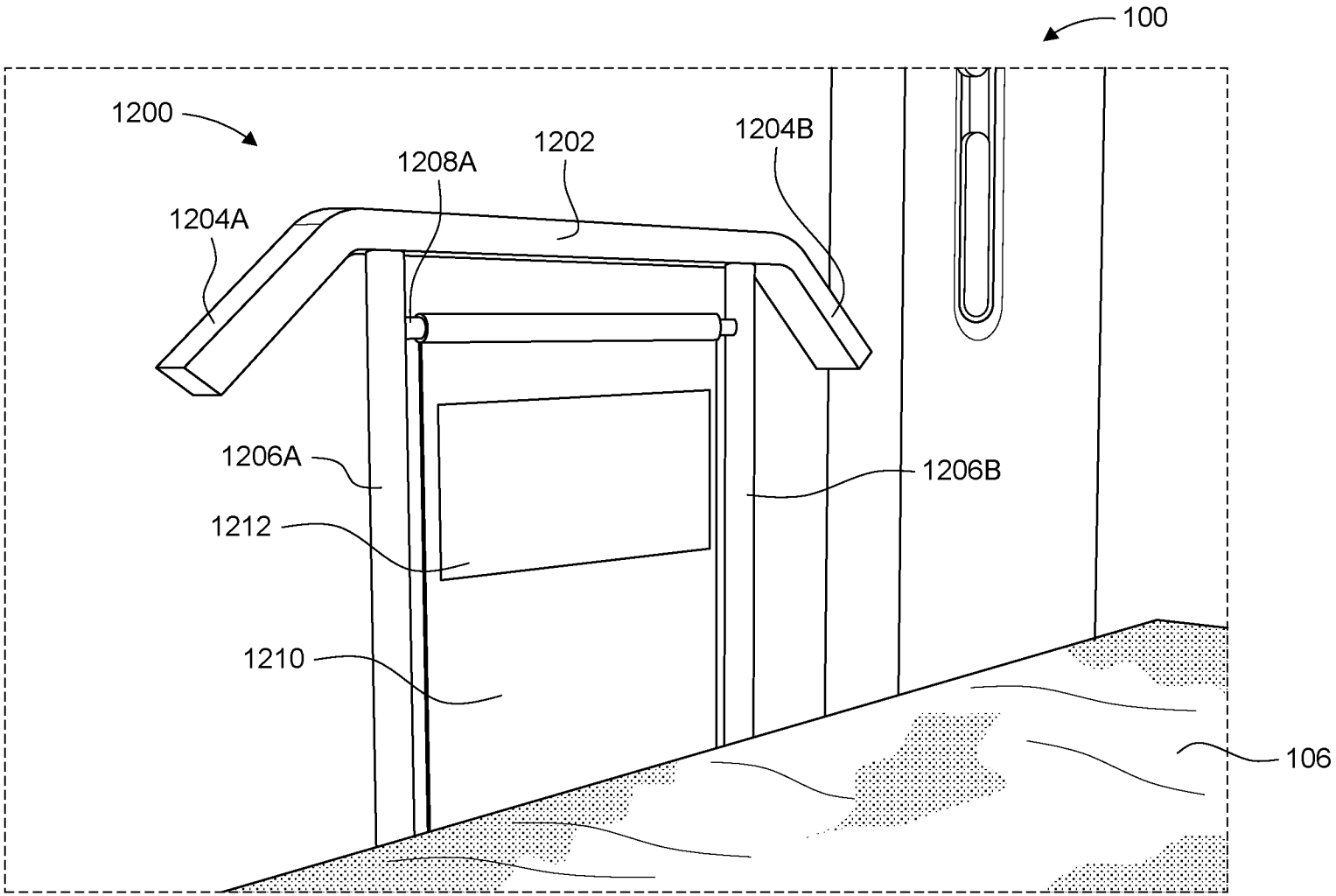
FIGS. 12A-F depict another example handle side rail accessory for the bed system.
Figure 12B:
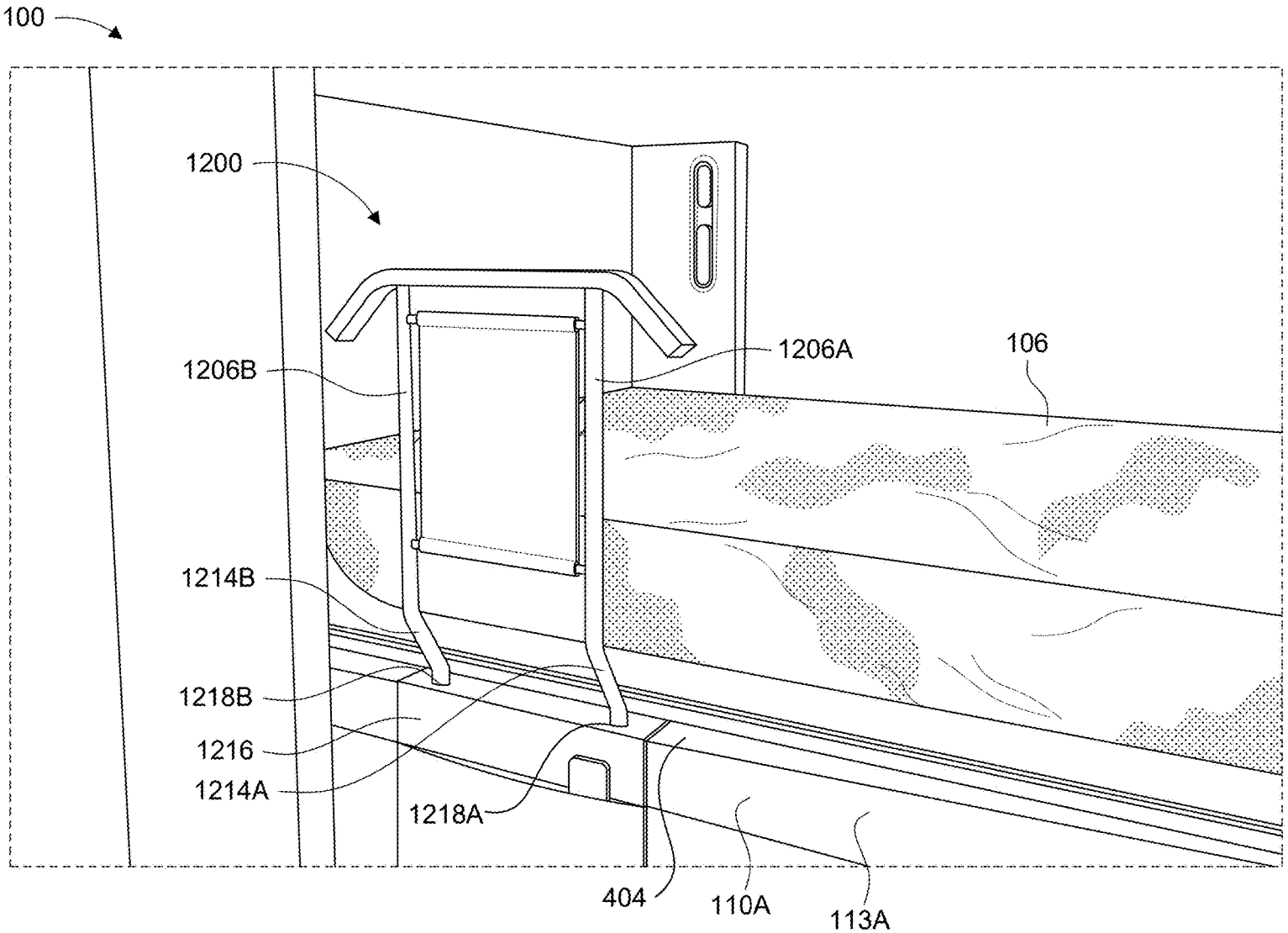
Figure 12C:
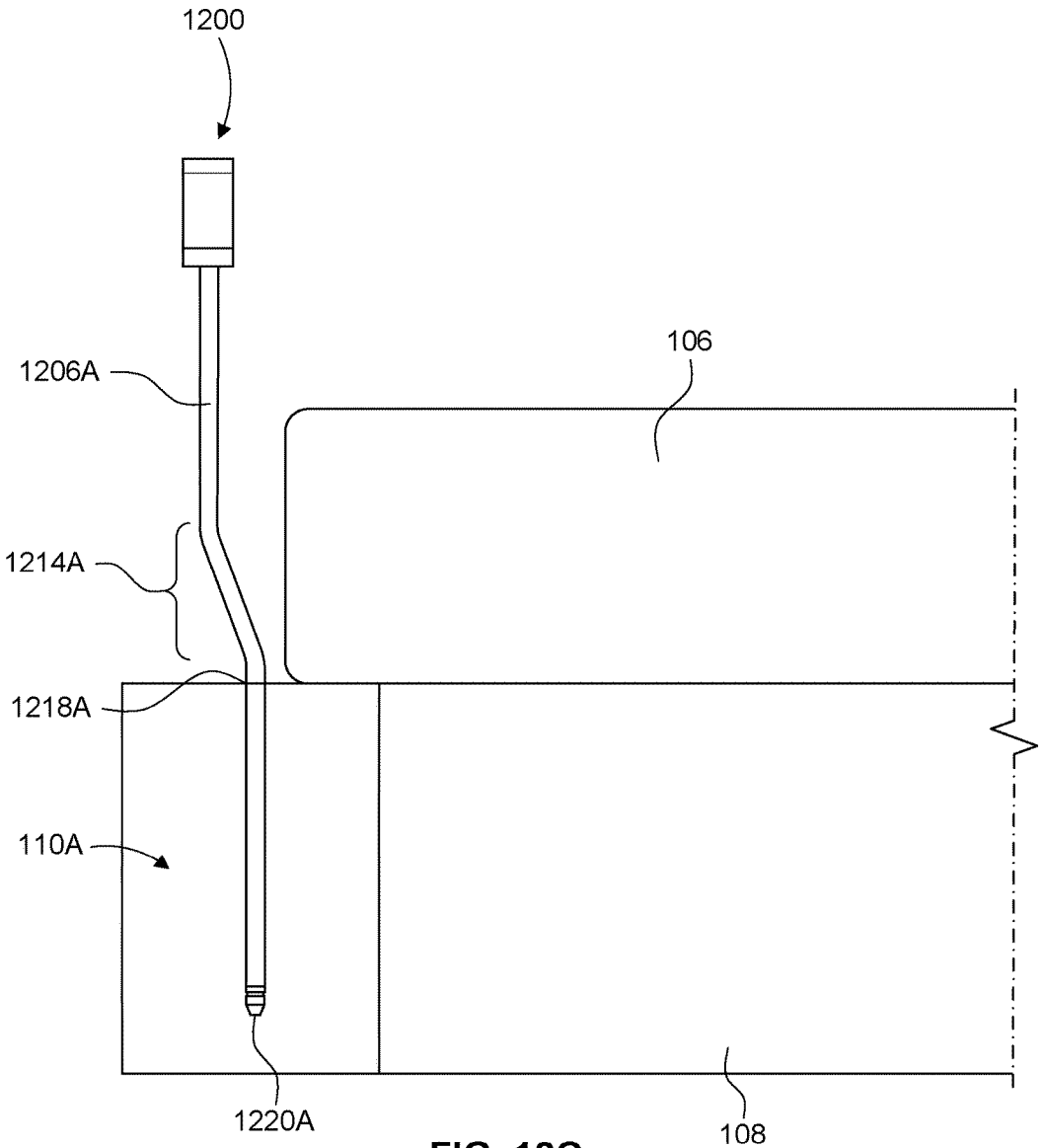
Figure 12D:
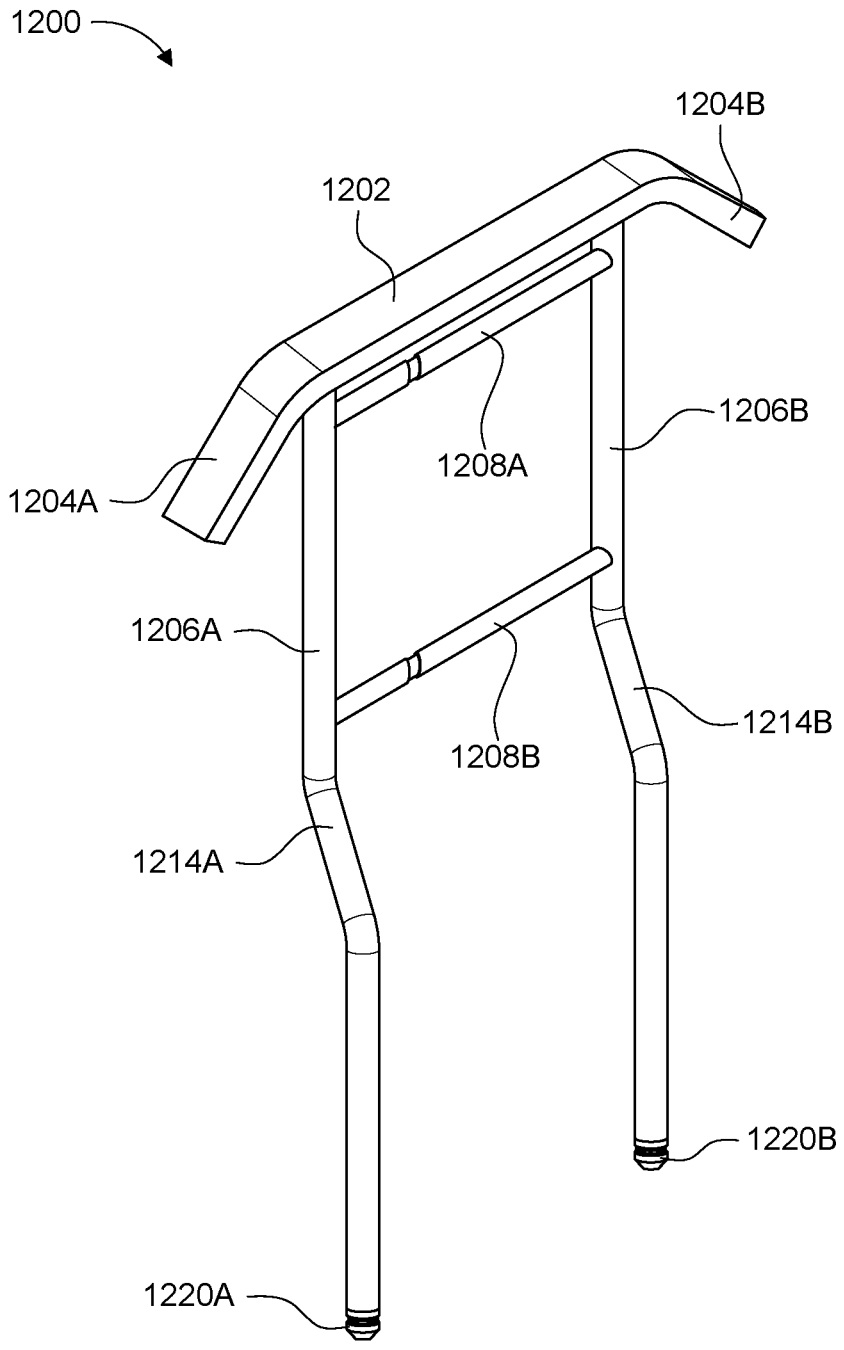

In some implementations, as shown in FIG. 12A for example, the wrap material 1210 can include a pocket 1212 integrated therein. The pocket 1212 can be positioned to face the mattress 106 and/or a user on the mattress 106. As a result, the user on the bed system 100 can access the pocket 1212 without having to move from the mattress 106. The pocket 1212 can be sized to fit various objects, including but not limited to magazines, books, mobile phones, laptops, tablets, remote controls, etc. The pocket 1212 can also be positioned closer to a top end of the wrap material 1210 so as to make the pocket 1212 accessible even when the bed system 100 has been articulated/adjusted and the mattress 106, for example, is tilted.

Figure 12E:
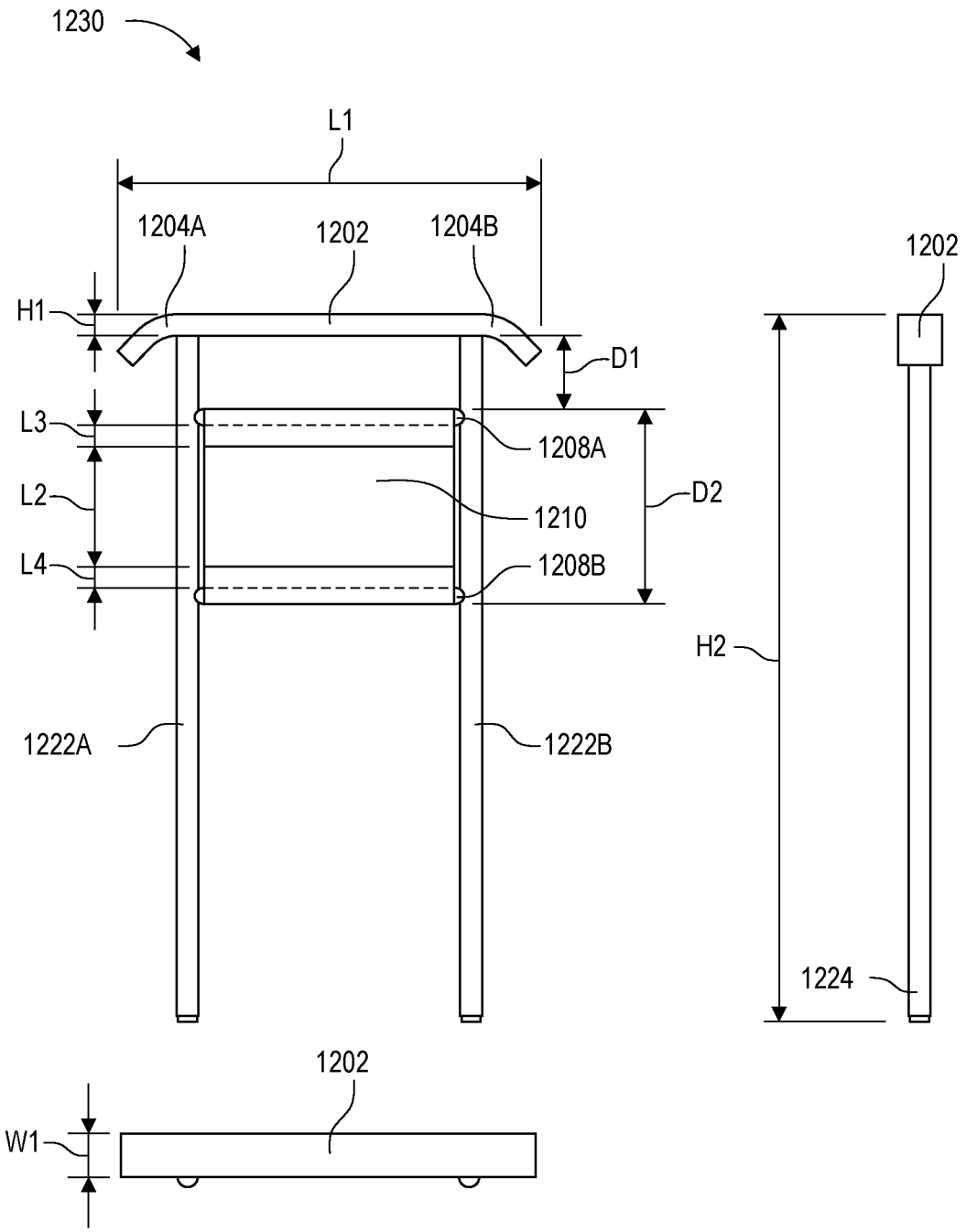
Figure 12F:
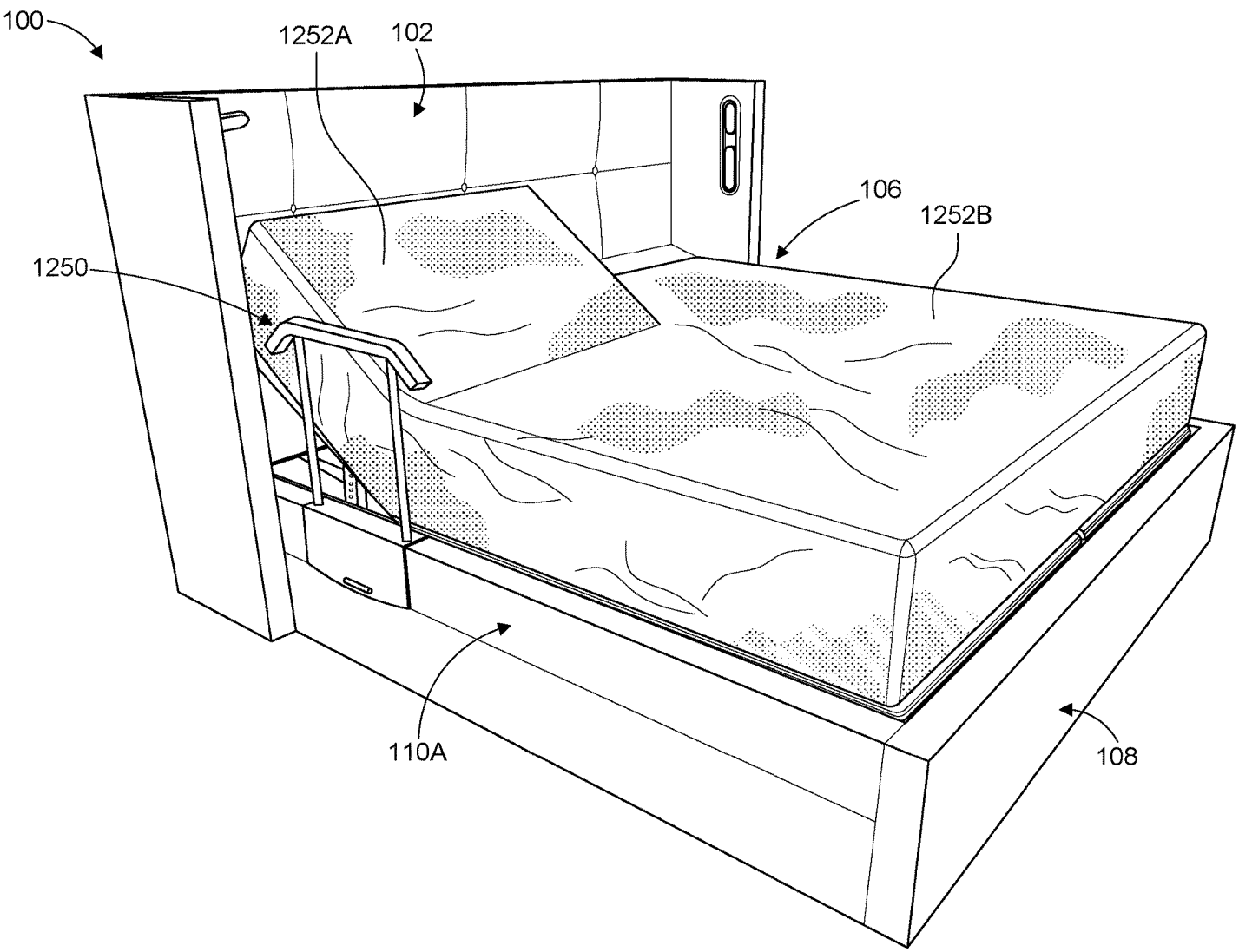

FIG. 12E depicts a handrail accessory 1230. The accessory 1230 is similar to the accessory 1200 described in FIGS. 12A-D. For example, the accessory 1230 has the handle 1202 with the curved first and second ends 1204A and 1204B, respectively. The accessory 1230 also includes the horizontal support poles 1208A and 1208B and the wrap material 1210. In contrast to the accessory 1200 described in FIGS. 12A-D, the accessory 1230 includes support poles 1222A and 1222B that are straight (in contrast to the bend in the support poles 1206A and 1206B at the portions 1214A and 1214B described in reference to FIG. 12D). The straight support poles 1222A and 1222B can provide numerous benefits. For example, the straight support poles 1222A and 1222B can prevent or reduce harmful pinch points from existing between the accessory 1230 and the mattress 106 when the bed system 100 is adjusted, thereby improving safety and preventing or reducing injury for the user of the bed system 100 (e.g., the user's fingers or other body parts may not get stuck between pinch points). The straight support poles 1222A and 1222B can therefore provide better safety and fit of the accessory 1230 when used with an articulating, adjustable bed system 100. Refer to FIG. 12F for further discussion.

The handle 1202 can have a length L1 of approximately 490 mm. The handle 1202 can have a height H1 of approximately 35 mm. The handle 1202 can have a width W1 of approximately 60 mm. A distance D1 between the horizontal support pole 1208A and a bottom surface of the handle 1202 can be approximately 85 mm. A distance D2 between the horizontal support pole 1208A and the horizontal support pole 1208B can be approximately 230 mm. The wrap material 1210 can have a length L2 of approximately 120 mm, which can extend a distance between the horizontal support poles 1208A and 1208B. The wrap material 1210 may also include equal lengths L3 and L4, each approximately 35 mm. The length L3 of the wrap material 1210 can extend from a top portion of the wrap material 1210 having the length L2 to the horizontal support pole 1208A (e.g., over a top surface of the horizontal support pole 1208A). The length L4 of the wrap material 1210 can extend from a bottom portion of the wrap material 1210 having the length L2 to the horizontal support pole 1208B (e.g., over a bottom surface of the horizontal support pole 1208B). Thus, the wrap material 1210 can have a combined length of approximately 190 mm. Furthermore, the accessory 1230 can have a total height H2 of approximately 835 mm, from a top surface of the handle 1202 to a bottom end 1224 of either of the support poles 1222A and 1222B. The measurements described in reference to FIG. 12E are merely illustrative and non-limiting examples. Any one or more of the measurements can also be different or within some threshold range for purposes of fitting with one or more different bed systems, sizes of bed systems, etc.

FIG. 12F depicts the bed system 100 described in at least FIGS. 1-2 and 12A-B when the mattress 106 is articulated. A handrail accessory 1250 can be attached to the side rail 110A of the foundation 108, as described herein. The handrail accessory 1250 can be the same as or similar to other handrail accessories described herein, including but not limited to the handle accessory 200 in at least FIG. 2, the handle side rail accessory 1200 in at least FIG. 12A, and the handrail accessory 1230 in FIG. 12E.

The mattress 106 has 2 sleeper sides, a first side 1252A and a second side 1252B. Each of the sides 1252A and 1252B can be individually articulable. In some implementations, both sides 1252A and 1252B of the mattress 106 can be articulated together or at a same time. Other mattress configurations described herein are also possible. As shown in FIG. 12F, the first side 1252A is articulated. Although the first side 1252A moves up and/or down to a user-desired position/height, the first side 1252A of the mattress 106 does not interfere with or touch the handrail accessory 1250. As a result, the user on the first side 1252A of the mattress 106 may not get injured when resting on top of the mattress 106 while the first side 1252A of the mattress 106 is articulated. Furthermore, the user can still use the handrail accessory 1250 as described throughout this disclosure, regardless of whether the first side 1252A of the mattress 106 is articulated.

Figure 13:
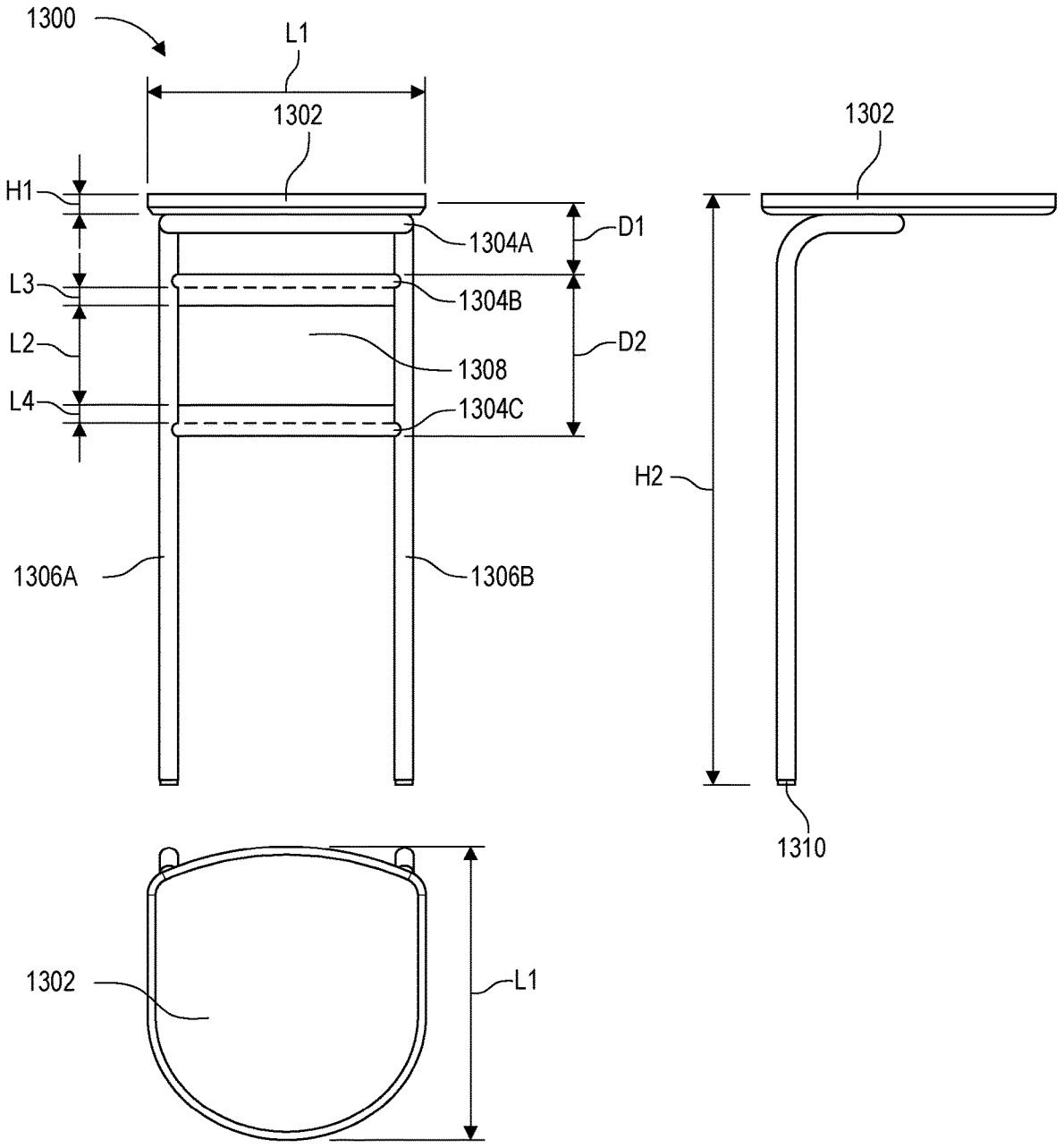
FIG. 13 depicts another example tabletop side rail accessory for the bed system.

FIG. 13 depicts an example tabletop side rail accessory 1300 for the bed system described throughout this disclosure. The accessory 1300 can be similar to some of the tabletop side rail accessories described herein, such as the tabletop accessory 202 in FIGS. 2B and 2F. The accessory 1300 includes a tabletop surface 1302 and vertical support poles 1306A and 1306B. The vertical support poles 1306A and 1306B can be similar to or the same as the support poles 1206A and 1206B described in reference to FIGS. 12A-E. The accessory 1300 can also include horizontal support poles 1304A, 1304B, and 1306C. The horizontal support pole 1304A can support the tabletop surface 1302. The horizontal support poles 1304B and 1304C can be similar to or the same as the horizontal support poles 1208A and 1208B described in reference to FIGS. 12A, 12D, and 12E. Furthermore, the accessory 1300 can include wrap material 1308, which can be configured to extend over and cover a gap formed between the horizontal support poles 1304B and 1304C. The wrap material 1308 is the same as or similar to the wrap material 1210 described in reference to FIGS. 12A and 12E.

The tabletop surface 1302 can have a length L1 within a range of and including 400-420 mm. The tabletop surface 1302 can have a height H1 of approximately 35 mm. A distance D1 between the horizontal support pole 1304B and a top surface of the horizontal support pole 1304A, or a bottom of the tabletop surface 1302, can be approximately 85 mm. A distance D2 between the horizontal support pole 1304B and the horizontal support pole 1304C can be approximately 230 mm. The wrap material 1308 can have a length L2 of approximately 120 mm, which can extend a distance between the horizontal support poles 1304B and 1304C. The wrap material 1308 may also include equal lengths L3 and L4, each approximately 35 mm. The length L3 of the wrap material 1308 can extend from a top portion of the wrap material 1308 having the length L2 to the horizontal support pole 1304B (e.g., over a top surface of the horizontal support pole 1304B). The length L4 of the wrap material 1308 can extend from a bottom portion of the wrap material 1308 having the length L2 to the horizontal support pole 1304C (e.g., over a bottom surface of the horizontal support pole 130C). Thus, the wrap material 1308 can have a combined length of approximately 190 mm. Furthermore, the accessory 1300 can have a total height H2 of approximately 835 mm, from a top of the tabletop surface 1302 to a bottom end 1310 of either of the support poles 1306A and 1306B. The measurements described in reference to FIG. 13 are merely illustrative and non-limiting examples. Any one or more of the measurements can also be different or within some threshold range for purposes of fitting with one or more different bed systems, sizes of bed systems, etc.

While this specification contains many specific implementation details, these should not be construed as limitations on the scope of the disclosed technology or of what may be claimed, but rather as descriptions of features that may be specific to particular embodiments of particular disclosed technologies. For example, in some embodiments, the shape of foundations, side rails, support poles, side rail accessories, plates, rail covers, mattresses, or other features can be varied as suitable for the application. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A foundation comprising:

a first side rail having first and second mounting holes each extending through a middle portion of the first side rail and configured to receive support poles of a side rail accessory and support the side rail accessory;

a second side rail positioned opposite of the first side rail;

a headboard extending across a head of the foundation between the first side rail and the second side rail; and an L-shaped plate extending over a portion of a top surface of the first side rail, the L-shaped plate configured to cover at least the first and second mounting holes when the side rail accessory is not installed in the first side rail.

2. The foundation of claim 1, wherein the L-shaped plate is removable.

3. The foundation of claim 1, wherein the first and second mounting holes are a same size, wherein the support poles are a same size, and wherein either of the support poles are configured to fit into either of the first and second mounting holes.

4. The foundation of claim 1, wherein the L-shaped plate includes first and second prongs that are positioned on an underside of the L-shaped plate and configured to align with the first and second mounting holes, wherein the first and second prongs plug the first and second mounting holes from the top surface of the first side rail when the first and second prongs are received by the first and second mounting holes with the underside of the L-shaped plate in contact with the top surface of the first side rail.

5. The foundation of claim 1, wherein the L-shaped plate includes a first portion that extends across a width and a length of the top surface of the first side rail to entirely cover a portion of the top surface between the first and second mounting holes and a second portion that extends across a length of the first side rail down an outer surface of the first side rail, wherein the first and second portions of the L-shaped plate join at an external facing edge of the first side rail.

6. The foundation of claim 1, wherein the second side rail includes third and fourth mounting holes configured to receive support poles of a second side rail accessory and support the second side rail accessory.

7. The foundation of claim 1, wherein the first and second mounting holes are parallel and extend vertically down into the first side rail and terminate within the first side rail at a location closer to a floor than to a top surface of the first side rail.

8. The foundation of claim 1, wherein the first and second mounting holes each extend from a top surface of the first side rail into the first side rail.

9. The foundation of claim 1, wherein the L-shaped plate comprises a plastic core.

10. The foundation of claim 9, wherein the L-shaped plate comprises one or more of a fabric or a leather wrapped around the plastic core.

11. The foundation of claim 5, wherein the first portion and the second portion of the L-shaped plate comprised no holes therethrough.

12. The foundation of claim 1, wherein the L-shaped plate is removable to install the side rail accessory in the first side rail, the foundation further comprising a rail cover comprising a top portion and a side portion, the top portion extending over a portion of the top surface of the first side rail and the side portion extending over a portion of an outer surface of the first side rail, the L-shaped plate comprising first and second receiving holes having a same size as the first and second mounting holes to pass the support poles to the first side rail.

* * * * *